US006385973B1

(12) United States Patent
Moran

(10) Patent No.: US 6,385,973 B1
(45) Date of Patent: May 14, 2002

(54) MICRO-SCALABLE THERMAL CONTROL DEVICE

(75) Inventor: Matthew E. Moran, Brunswick, OH (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/906,012

(22) Filed: Jul. 12, 2001

(51) Int. Cl.[7] ..... F01B 29/10
(52) U.S. Cl. ..... 60/520; 60/526; 60/508
(58) Field of Search ..... 60/517, 520, 508, 60/526; 62/6

(56) References Cited

U.S. PATENT DOCUMENTS

| | | | | |
|---|---|---|---|---|
| 5,457,956 A | | 10/1995 | Bowman | |
| 5,749,226 A | | 5/1998 | Bowman | |
| 5,812,235 A | * | 9/1998 | Peterson | 62/6 |
| 5,941,079 A | | 8/1999 | Bowman | |
| 6,272,866 B1 | * | 8/2001 | Tsai et al. | 62/3.1 |

* cited by examiner

*Primary Examiner*—Hoang Nguyen
(74) *Attorney, Agent, or Firm*—Kent N. Stone

(57) ABSTRACT

A microscalable thermal control module consists of a Stirling cycle cooler that can be manipulated to operate at a selected temperature within the heating and cooling range of the module. The microscalable thermal control module is particularly suited for controlling the temperature of devices that must be maintained at precise temperatures. It is particularly suited for controlling the temperature of devices that need to be alternately heated or cooled. The module contains upper and lower opposing diaphragms, with a regenerator region containing a plurality of regenerators interposed between the diaphragms. Gaps exist on each side of each diaphragm to permit it to oscillate freely. The gap on the interior side one diaphragm is in fluid connection with the gap on the interior side of the other diaphragm through regenerators. As the diaphragms oscillate working gas is forced through the regenerators. The surface area of each regenerator is sufficiently large to effectively transfer thermal energy to and from the working gas as it is passed through them. The phase and amplitude of the oscillations can be manipulated electronically to control the steady state temperature of the active thermal control surface, and to switch the operation of the module from cooling to heating, or vice versa. The ability of the microscalable thermal control module to heat and cool may be enhanced by operating a plurality of modules in series, in parallel, or in connection through a shared bottom layer.

37 Claims, 14 Drawing Sheets

MICRO-SCALABLE THERMAL CONTROL DEVICE

ORIGIN OF THE INVENTION

The invention described herein was made by an employee of the United States government and may be manufactured and used by or for the Government for governmental purposes without payment of any royalties thereon or therefor.

TECHNICAL FIELD

This invention relates generally to heat transfer systems. Specifically, this invention relates to microscale Stirling cycle devices, which may be used to heat, cool, or maintain a steady temperature in associated items such as electronics, sensors, microelectromechanical system (MEMS) devices, or spacecraft components.

BACKGROUND ART

The development of electronics and microelectromechanical systems has been accompanied by the need for systems of similar small size to control the temperature of these items. Some of the systems that have been used for temperature control of devices of any size have included natural convection enhancements, conduction enhancements, radiation enhancements, forced air systems, liquid cooling loops, heat pipes, thermoelectric devices, standard thermodynamic cycle devices, resistance heaters, combustion heaters, and various combinations thereof. Devices of these types have historically been large, when compared to the sizes of microelectronic or MEMS devices. It has been difficult to miniaturize many of these traditional heating and cooling devices. This is because the material and means of manufacture of the traditional components of these devices, such as the pistons, linkages, and pressure vessels of a traditional Stirling cooler, for example, are generally not suited for microscale production.

In addition to the difficulties of miniaturization, most heat transfer systems act either to cool or to heat, but not both. This limitation applies both to microscale and traditional scale thermal control devices. Under circumstances when it was necessary to alternately heat or cool a device it has commonly been necessary, or most efficient, to perform the heating and cooling tasks with separate or multiple devices. This also applies to circumstances when it is necessary to precisely maintain the temperature of a device.

One system that has been employed for cooling utilizes the Stirling cycle. One embodiment of a Stirling cycle for refrigeration uses two pistons to create a temperature difference between one end of the system and the other. Each piston is made to oscillate sinusoidally. The operation of the pistons is out of phase with each other. A typical phase shift in a functional device is generally between 90 degrees and 120 degrees. Initially, the working gas is compressed by two pistons moving in opposite directions toward each other or by one piston moving toward a second fixed piston. Ideally, compression occurs isothermally with the working gas transferring just enough heat to the surrounding cylinder walls so that the temperature remains constant as the pressure increases and the volume decreases. The working gas is then moved through a regenerator region by the parallel motion of the two pistons. As the working gas moves through a regenerator region, it transfers more heat to the cooler regenerator.

Next, the cooled gas is expanded by the pistons moving in opposite directions or by one piston moving away from a second fixed piston. Ideally, this expansion occurs isothermally, with the working gas accepting just enough heat from the cylinder walls so that the temperature remains constant as the pressure decreases and the volume increases. The working gas is then moved back through the regenerator by the parallel motion of the pistons. As the gas moves through the regenerator, it accepts additional heat from the warmer regenerator.

As the cycle continues, the temperature difference between the warm side of the system and the cool side of the system increases. The temperature of each side eventually approaches a steady state temperature.

Stirling cycle heat transfer systems have generally been too large for use with MEMS and other small electronic devices. Previous attempts to miniaturize Stirling cycle coolers were limited by increased thermal conductivity though the regenerator region as the frequency of oscillations increased, the decreased exchange of thermal energy between the walls of the regenerator region, and the increasing viscosity of the working fluid. Bowman, et al., U.S. Pat. Nos. 5,457,956, 5,749,226, and 5,941,079, have attempted to apply Stirling cycle principles to a micro-scale cryocooler. The Bowman Stirling cryocooler utilizes small regenerator passages and high frequency, low amplitude oscillations to overcome some of the problems associated with miniaturizing a Stirling cooler.

While Bowman represents an advance, it still does not solve many of the problems associated with the temperature control of MEMS. Some MEMS require both heating and cooling. The Bowman device functions as a cooler. In addition, Bowman teaches an unmoderated means for cooling. There is often a need to precisely control temperature in a manner that cannot be achieved by Bowman. For example, a microscale device including biological material may need to be held within a very narrow temperature range. As a second example, certain temperature sensitive sensors of microscale or larger size may need to be held within a very narrow temperature range, in order to produce accurate readings. Also, most applications requiring cooling or temperature control operate well above the cryogenic temperature range of the Bowman device. Finally, the. Bowman devices must be custom designed for a particular application.

Thus, there still exists a need for an active thermal control device that can be produced in a microscale size. In addition there still exists a need for a single thermal control device that selectively heats, cools, and can precisely control temperature. Further, there still exists a need for a microscale cooler that operates at temperatures above the cryogenic range. Finally, there still exists a need for a modular thermal control device that can be used in conjunction with other modular thermal control devices to closely fit the unique surfaces of each of a plurality of items that require temperature control.

DISCLOSURE OF INVENTION

It is an object of an exemplary form of the present invention to provide a modular thermodynamic device that is capable of both heating and cooling an associated device.

It is a further object of an exemplary form of the present invention to provide a modular thermodynamic device that is capable of achieving and maintaining a designated steady state temperature in the associated device.

It is a further object of an exemplary form of the present invention to provide a modular thermodynamic device that is capable of being used in series with other modular thermodynamic devices to provide wider range of temperatures to which the associated device can be heated or cooled.

It is a further object of an exemplary form of the present invention to provide a modular thermodynamic device that is capable of being used in parallel with other modular thermodynamic devices to provide a capacity to heat or cool a relatively larger surface area than the surface of a single modular thermodynamic device.

It is a further object of an exemplary form of the present invention to provide a modular thermodynamic device that is capable of being used both in parallel and in series with other modular thermodynamic devices to heat or cool a relatively larger surface area over a wider range of temperatures, as compared to the range of a single modular thermodynamic device.

It is a further object of an exemplary form of the present invention to provide a modular thermodynamic device that is capable of heating or cooling a curvilinear surface.

It is a further object of an exemplary form of the present invention to provide a modular thermodynamic device which can be used in series with other modular thermodynamic, the series combination being capable of heating or cooling a curvilinear surface to a relatively wider range of temperatures than that is generally achieved by the use of a single modular thermodynamic device.

Further objects of an exemplary form of the present invention will be made apparent in the following Best Modes for Carrying Out Invention and the appended claims.

The foregoing objects are accomplished in an exemplary embodiment of the invention by a microscalable temperature control module that utilizes the Stirling cycle. The microscalable temperature control module is operative to create a temperature difference between two thermal energy transfer layers. One of the thermal energy transfer layers is in contact with an associated device that is to be heated, cooled, or maintained at a selected temperature. The microscalable temperature control module either transfers heat to, or receives heat from, the surface of the associated device. Through this heat transfer, the temperature of the associated device approaches the same temperature as the thermal energy transfer layer with which it is in contact.

When used in isolation, an exemplary embodiment of a microscalable temperature control module has a temperature sensor on one thermal energy transfer surface to monitor the surface temperature of the device. The temperature sensor is electronically linked to a controller that is operative to control the phase of the oscillations of the microscalable temperature control module. By shifting the phase of the oscillations, such a microscalable temperature control module can be electronically switched from heating to cooling, or vice versa. By the use of feedback from the temperature sensor to switch such a microscalable temperature control module from heating or cooling as needed, very precise temperature control can be maintained. Because the surface of such a microscalable temperature control module is in contact with the surface of the associated device, the associated device will approach the same temperature as the surface with which it is in contact.

In alternative embodiments, multiple copies of the microscalable temperature control module can be configured so as to increase the range of temperatures at which the steady state temperature can be maintained. Such embodiments may also be suitable to increase the surface area over which temperature can be controlled. Alternative embodiments may also enable temperature control of a curvilinear surface or other regular or irregular surface contour. When used in multiples, the microscalable temperature control modules may be electronically controlled by the same temperature sensor.

BEST MODES FOR CARRYING OUT INVENTION

Figure 1:
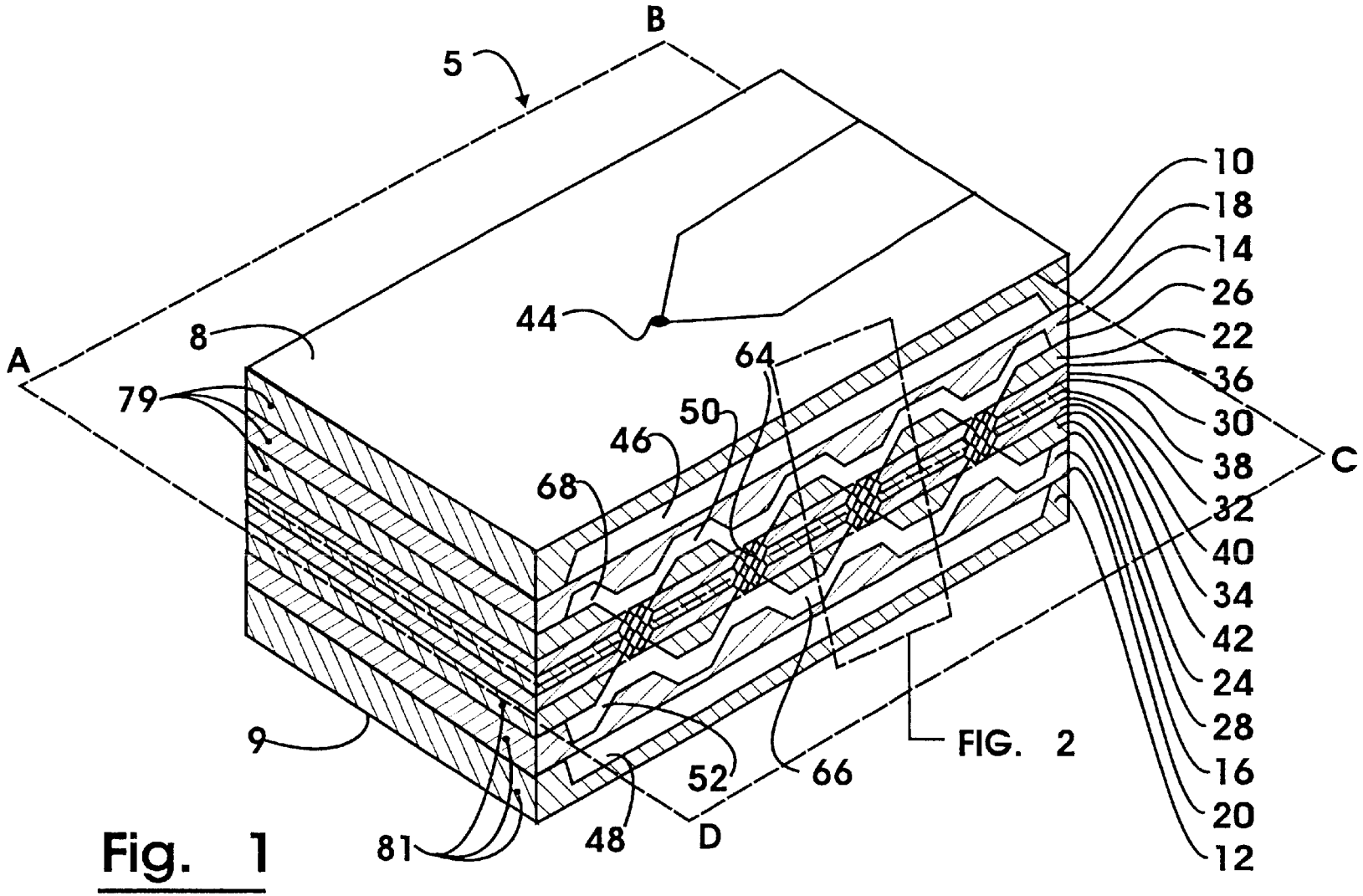
FIG. 1 is a cut-away perspective view of a microscalable temperature control module.

Referring now to the drawings, in particular to FIG. 1, there is shown therein a first exemplary embodiment of a microscalable temperature control module generally referred to by reference numeral 5. Module 5 comprises a plurality of rectangular layers. Portions of all functional layers are removed to give module 5 an internal structure, described in more detail below.

Module 5, in an exemplary embodiment shown, is symmetric with respect to a plane ABCD that is parallel to the layers and that passes through the longitudinal center of a module 5. Module 5 is bounded by a first thermal energy transfer layer 10, and second thermal energy transfer layer 12.

Interior and adjacent to the first thermal energy transfer layer 10 is a first diaphragm layer 14. Similarly, interior and adjacent to the second thermal energy transfer layer 12 is a second diaphragm layer 16. Interposed between the first thermal energy transfer layer 10 and the first diaphragm layer 14, at all points of contact between said layers, is thin insulation layer 18. In an exemplary embodiment, the insulation layer 18 comprises silicon dioxide. Similarly, interposed between the second thermal energy transfer layer 12 and the first diaphragm layer 16, at all points of contact between said layers, is thin insulation layer 20. In an exemplary embodiment, the insulation layer 20 comprises silicon dioxide. In other embodiments, the insulation layers 18 and 20 may comprise some material other than silicon dioxide which facilitates electrical isolation, thermal isolation, or both.

In the exemplary embodiment, the insulation layers 18 and 20 are interposed solely between the thermal energy transfer layers 10 and 12 and the diaphragm layers 14 and 16 at the points of contact between these layers. In other embodiments, the insulation layers 18 and 20 may coat the entire facing surfaces of each of the thermal energy transfer layers 10 and 12 and the diaphragm layers 14 and 16. In further embodiments, the insulation layers 18 and 20 may be absent entirely. In embodiments in which the insulation layers 18 and 20 coat the entire facing surfaces of each of the thermal energy transfer layers 10 and 12 and the diaphragm layers 14 and 16, the insulation layer may be comprised of the same substance over the entire surface or may be comprised of more than one substance with different insulation properties at different locations on the thermal energy transfer layers 10 and 12 or the diaphragm layers 14 and 16.

Interior and adjacent to the first diaphragm layer 14 is a first entrance layer 22. Interposed between the first diaphragm layer 14 and the first entrance layer 22, at all points of contact between said layers, is a thin insulation layer 26. In an exemplary embodiment, the insulation layer 26 comprises silicon dioxide. Interior and adjacent to the first diaphragm layer 14 is a first entrance layer 22. Similarly, interposed between the second diaphragm layer 16 and the second entrance layer 24, at all points of contact between said layers, is thin insulation layer 28. In an exemplary embodiment, the insulation layer 28 comprises silicon dioxide. In other embodiments, the insulation layers 26 and 28 may comprise some material other than silicon dioxide which facilitates electrical isolation, thermal isolation, or both. In further embodiments, the insulation layers 26 and 28 may be absent entirely.

The center of a module 5 comprises a plurality of regenerator layers. First, second, and third regenerator layers 30, 32, and 34 are illustrated in an exemplary embodiment. It should be understood, however, that other embodiments may include fewer or more regenerator layers. Interposed between the first regenerator layer 30 and the first entrance layer 22, at all points of contact between said layers, is thin insulation layer 36. In an exemplary embodiment, the insulation layer 36 comprises silicon dioxide. Similar insulation layers 38, 40, and 42, are interposed between the first regenerator layer 30 and the second regenerator layer 32, between the second regenerator layer 32 and the third regenerator layer 34, and between the third regenerator layer 34 and the second entrance layer 24. In the exemplary embodiment, the insulation layers 38, 40, and 42 comprise silicon dioxide. In other embodiments, the insulation layers 36, 38, 40, and 42 may comprise some material other than silicon dioxide which facilitates electrical isolation, thermal isolation, or both.

Each layer described above is bonded at all points of contact to each layer adjacent to it. Because of the internal structure of a module 5, described in more detail below, this bonding creates as many as three sealed cavities. One sealed cavity, the first diaphragm clearance gap 46, is created by the structure of the first thermal energy transfer layer 10, the structure of the first diaphragm layer 14, and the bonded connection between them. A second sealed cavity, the second diaphragm clearance gap 48 is created by the structure of the second thermal energy transfer layer 12, the structure of the second diaphragm layer 16, and the bonded connection between them. In an exemplary embodiment, the diaphragm clearance gaps 46 and 48 contain a gas such as hydrogen. In other embodiments, the diaphragm clearance gaps 46 and 48 may contain a vacuum or other gases including, but not limited to, helium or air. In further embodiments, diaphragm gaps 46 and 48 may not be sealed.

A third sealed cavity is the working gas region 66. In an exemplary embodiment illustrated in FIG. 1, the working gas region 66 comprises two thin layers in fluid connection with each other through a plurality of distinct regions each with shapes approximating rectangular columns. The thin layers represent the expansion/compression regions. The rectangular columns represent the passages though the regenerator layers, each of which is comprised of a plurality of smaller passages. A one-dimensional view of the shape of the working gas region can be seen in the cut away edge of a module 5 revealed in FIG. 1.

A first portion of the working gas region 66 is situated between the first diaphragm layer 14 and the first entrance layer 22. The surfaces of this region are formed by the first diaphragm layer 14 and the first entrance layer 22. This region is bounded on the outer edges by the bond between the first diaphragm layer 14 and the first entrance layer 22, and is referred to as the first expansion/compression region 50. A second portion of the working gas region 66 is situated between the second diaphragm layer 16 and the second entrance layer 24. The surfaces of this region are formed by the second diaphragm layer 16 and the second entrance layer 24. This region is bounded on the outer edges by the bond between the second diaphragm layer 16 and the second entrance layer 24. This region is referred to as the second expansion/compression region 52.

The regenerator passages 64 fluidly connect these two previously discussed portions of the working gas region 66 to each other. These connecting portions are bounded on all sides by the walls of the regenerator passages 64. In an exemplary embodiment, the working gas region 66 contains hydrogen. In other embodiments the working gas may comprise other gases, including, but not limited to, helium or air. Although an exemplary embodiment comprises three closed regions, in other embodiments the working gas region 66 may be further partitioned, so long as each closed region contains at least two opposing expansion/compression regions 50 and 52 connected by at least one regenerator passage 64.

Figure 2:
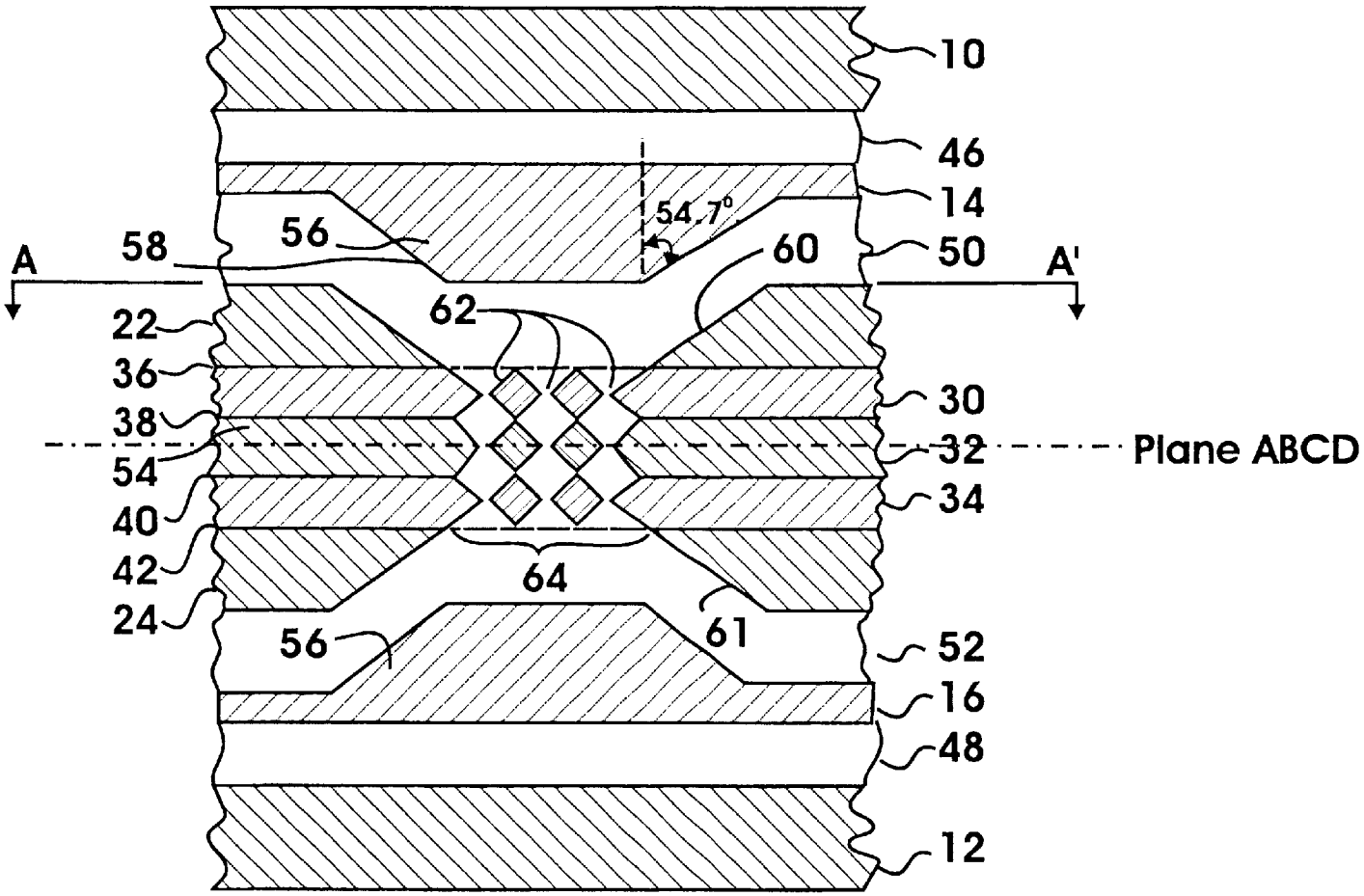
FIG. 2 is a partial cut-away view of a portion of the module shown in FIG. 1.
Figure 3:
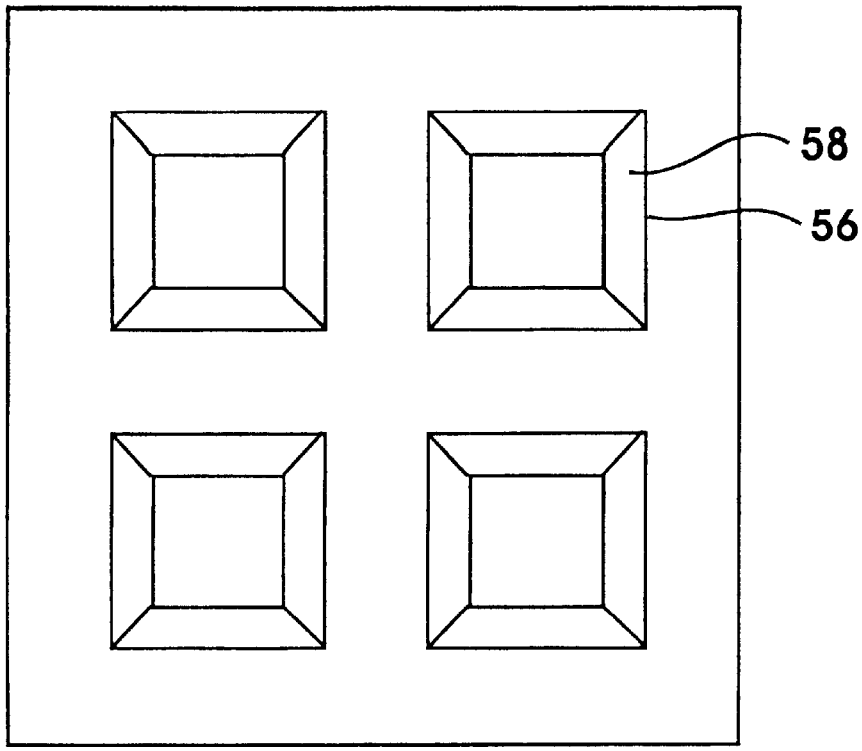
FIGS. 3 and 4 are views of the surface of the diaphragm layer and of the entrance layer, respectively, from the perspective of the expansion/compression layer represented as line A—A' in FIG. 2.
Figure 4:
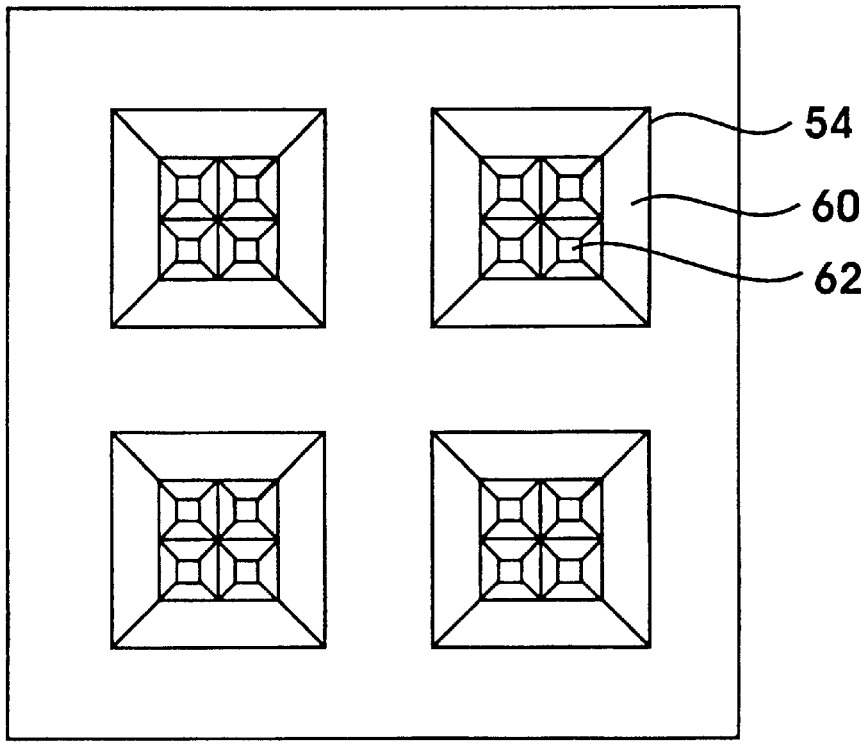

Turning in more detail to the internal structure of a module 5, as illustrated in FIGS. 2–4 the first diaphragm layer 14 oscillates within two gaps, the first diaphragm clearance gap 46 and the first expansion/compression region 50. In an exemplary embodiment, the first diaphragm clearance gap 46 is created by removing a portion of the interior surface of the first thermal energy transfer layer 10 by wet etching techniques. In other embodiments, the first diaphragm clearance gap 46 may be created by other means. The first diaphragm clearance gap 46 has dimensions that permit the first diaphragm layer 14 to oscillate away from the horizontal plane ABCD. The first diaphragm layer 14 may, in some embodiments, make physical contact with the first thermal energy transfer layer 10. In other embodiments, the motion of the first diaphragm layer 14 may stop short of the first thermal energy transfer layer 10.

The first diaphragm layer 14 contains a plurality of diaphragm boss features 56 on its interior side in a one to one correspondence with regenerators 54, as illustrated in FIGS. 1, 3 and 4. Each regenerator 54 comprises a regenerator passage 64, a first working gas entrance 60 and a second working gas entrance 61, and adjacent portions of the entrance layers 22–24, regenerator layers 30, 32, and 34 and insulation layers 26, 28, 36, 38, 40 and 42. In an exemplary embodiment illustrated in FIGS. 3 and 4, there are four diaphragm boss features 56 and four corresponding regenerators 54. Other embodiments may contain a different number of pairs comprising a diaphragm boss feature 56 and regenerator 54. In an exemplary embodiment, the pairs are arranged in a square. Other embodiments may contain different geometric arrangements of the pairs.

In an exemplary embodiment, the diaphragm boss features 56 are created before assembly by etching away portions of the diaphragm layer 14 using the wet etching process. As an artifact of the wet etching process, each slanted side 58 of the diaphragm boss feature 56 forms a 54.7 degree angle to the vertical, as illustrated in FIG. 2. In like manner, portions of the first entrance layer 22 are removed to create a working gas entrance 60. In an exemplary embodiment, the portions of the first entrance layer 22 are etched away using the wet etching process, leaving the working gas entrances 60 with a characteristic 54.7 degree angle to the vertical as illustrated in FIG. 2. In other embodiments, the diaphragm boss features 56 and first entrance layer 22 may be created by other means. These generally parallel surfaces of the diaphragm layer 14 and the first energy layer 22 form the first diaphragm clearance gap 46. The second diaphragm layer 16, its diaphragm boss features 56, the second diaphragm clearance gap 48, and the second entrance layer 24 are shaped as mirror images of the corresponding first layers 14 and 22 and clearance gap 46.

Figure 5:
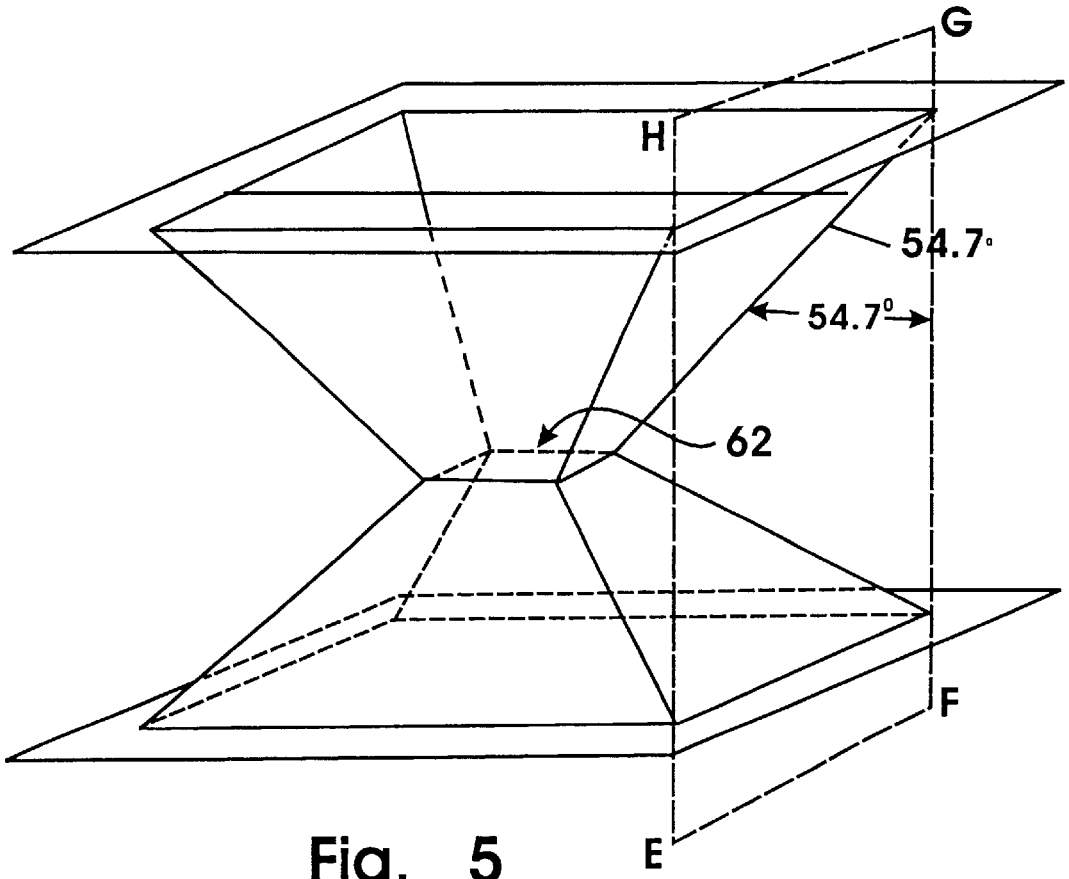
FIGS. 5 and 6 are representations of the shape of one and twelve regenerator passages, respectively.

In the embodiment illustrated in FIGS. 2–4, the regenerator passages 64 are created by means of wet etching and wafer bonding techniques known to those skilled in the art. A plurality of orifices 62 are created through each regenerator layer 30, 32 and 34 by selectively etching the upper and lower surfaces of each layer before the layers are bonded together. Because the etching process creates a characteristic angle, the resulting orifices 62 are in the shape of paired truncated pyramids joined at their small bases, as illustrated in FIG. 5. Each side of said truncated pyramids makes a 54.7 degree angle to a plane perpendicular to the bases of the truncated pyramid. Using techniques currently available, the width of each regenerator orifice 62 can be made as small as 2 microns.

Figure 6:
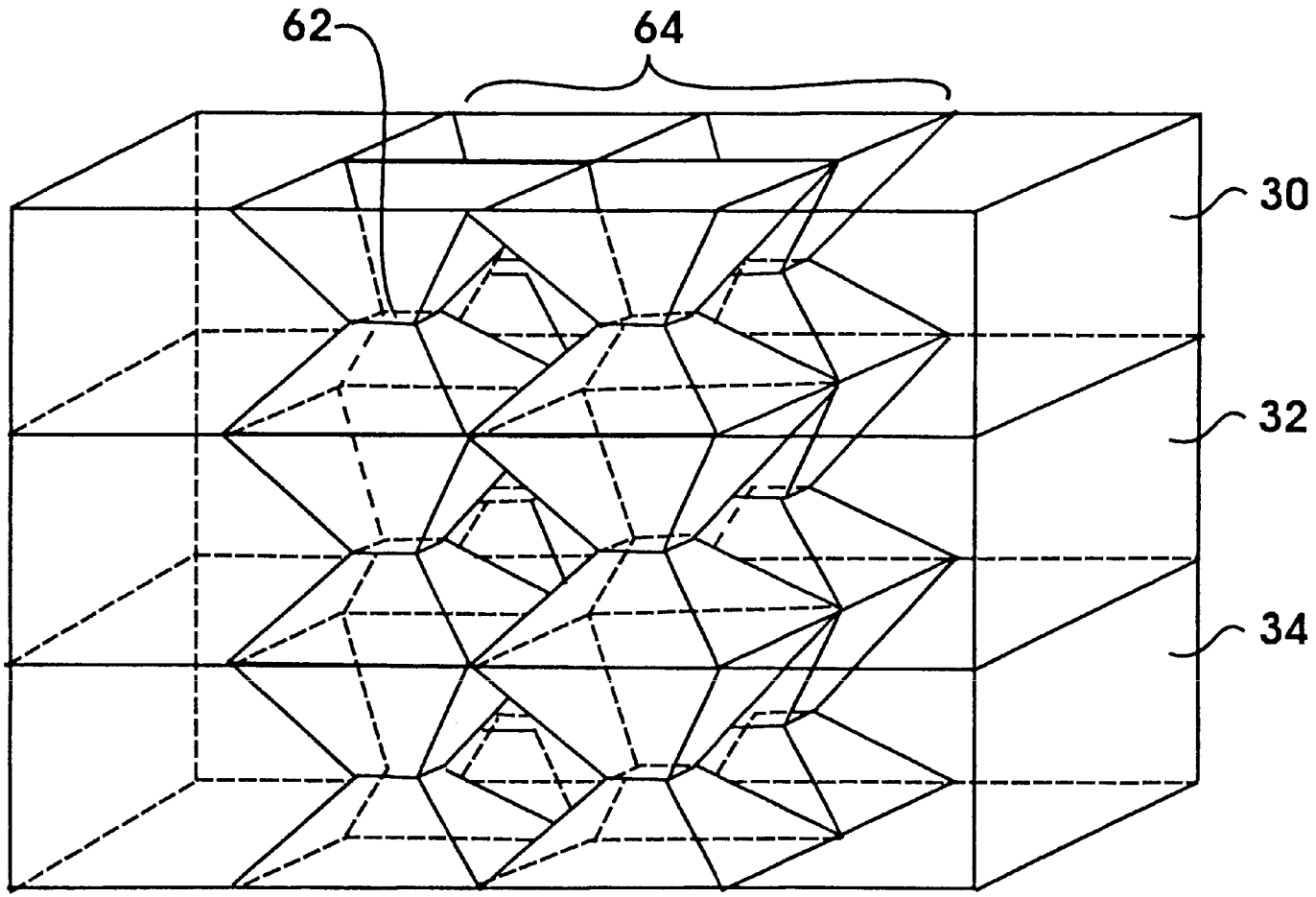

FIG. 6 illustrates an exemplary embodiment of a single exemplary regenerator passage 64, comprising four regenerator orifices 62 arranged in a square, through three regenerator layers 30, 32 and 34. In this exemplary embodiment, each regenerator passage 64 comprises four orifices 62 arranged in a square. In other embodiments, a regenerator passage 64 may comprise a different number of orifices 62 in a different arrangement. When the layers 30, 32, and 34 of this exemplary regenerator 54 embodiment are bonded together, these matching layers of clusters of regenerator orifices 62 create regenerator passages 64 that resemble a series of converging and diverging nozzles. Although in this exemplary embodiment the regenerator 54 comprises 3 regenerator layers, in other embodiments a regenerator 54 may comprise more or fewer than three regenerator layers.

A temperature sensor 44, which provides active feedback as to the temperature achieved may be located on a module surface 8 or 9. In an exemplary embodiment, the temperature 44 sensor is a thin-film temperature sensor and is located on the first module surface 8, as shown in FIG. 1. The temperature sensor 44 can be made flush with a module surface 8 or 9 by creating channels in a module surface 8 or 9. The temperature sensor 44 and its leads may then be embedded in the channels. In an exemplary embodiment, the channels are created using wet etching techniques known to those skilled in the art.

Figure 23:
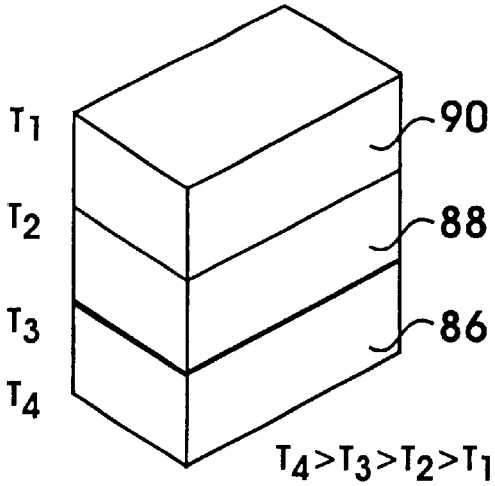
FIG. 23 is a representational view of three microscalable temperature control modules in series.
Figure 24:
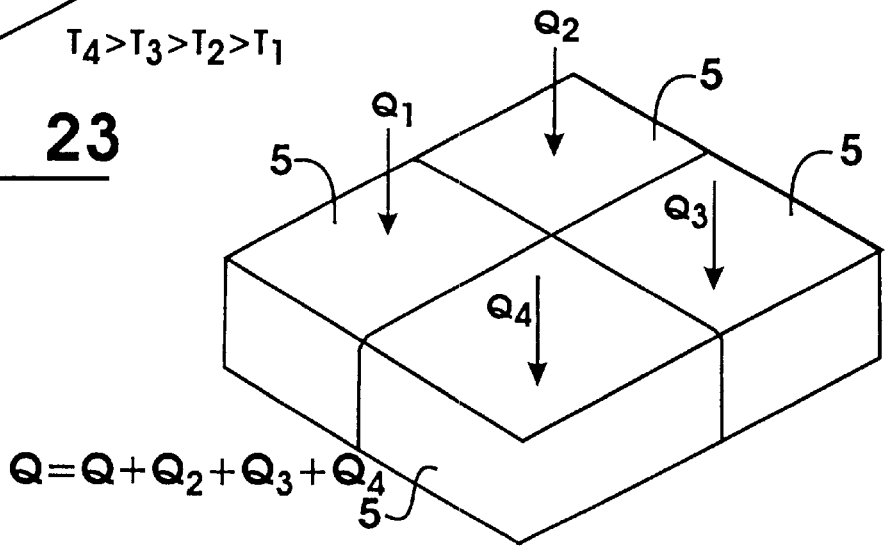
FIG. 24 is a representational view of four microscalable temperature control modules in parallel.

Although an exemplary embodiment illustrates one temperature sensor 44 on a module surface 8, some embodiments may include fewer or more temperature sensors 44. For example, when a plurality of modules 5 are used in series or parallel, as illustrated in FIGS. 23 and 24, it may not be necessary for each module 5 to have a corresponding temperature sensor 44. If, as a further example, an embodiment includes a partitioned working gas region 66, such an embodiment may include more than one temperature sensor 44.

Figure 25:
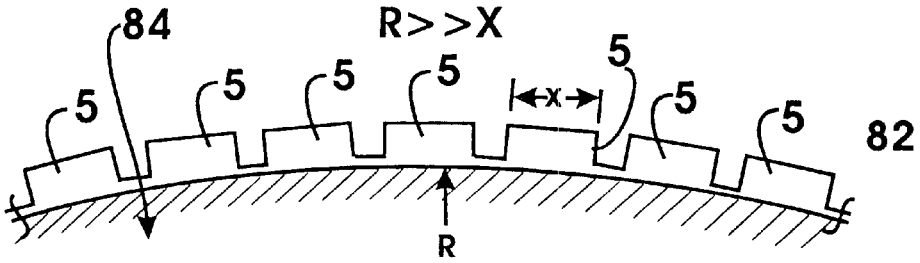
FIG. 25 is a representational view of a plurality of microscalable temperature control modules in parallel on a non-planar surface.

Although the temperature sensor 44 will generally be affixed directly to a thermal energy transfer layer 10 or 12 of each module 5, there may be instances when another configuration is preferable. FIG. 25 illustrates the use of multiple modules 5 to control the temperature of a non-planar surface. As discussed more fully below, it may be desirable to have a shared bottom plate 82, in addition to or integral with, a thermal energy transfer layer 10 or 12. In that instance, a temperature sensor 44 may be placed on the surface of the shared bottom plate 82. In other embodiments, it may be preferable to locate the temperature sensor on or inside the associated item at the precise location for which temperature control is critical.

Figure 22:
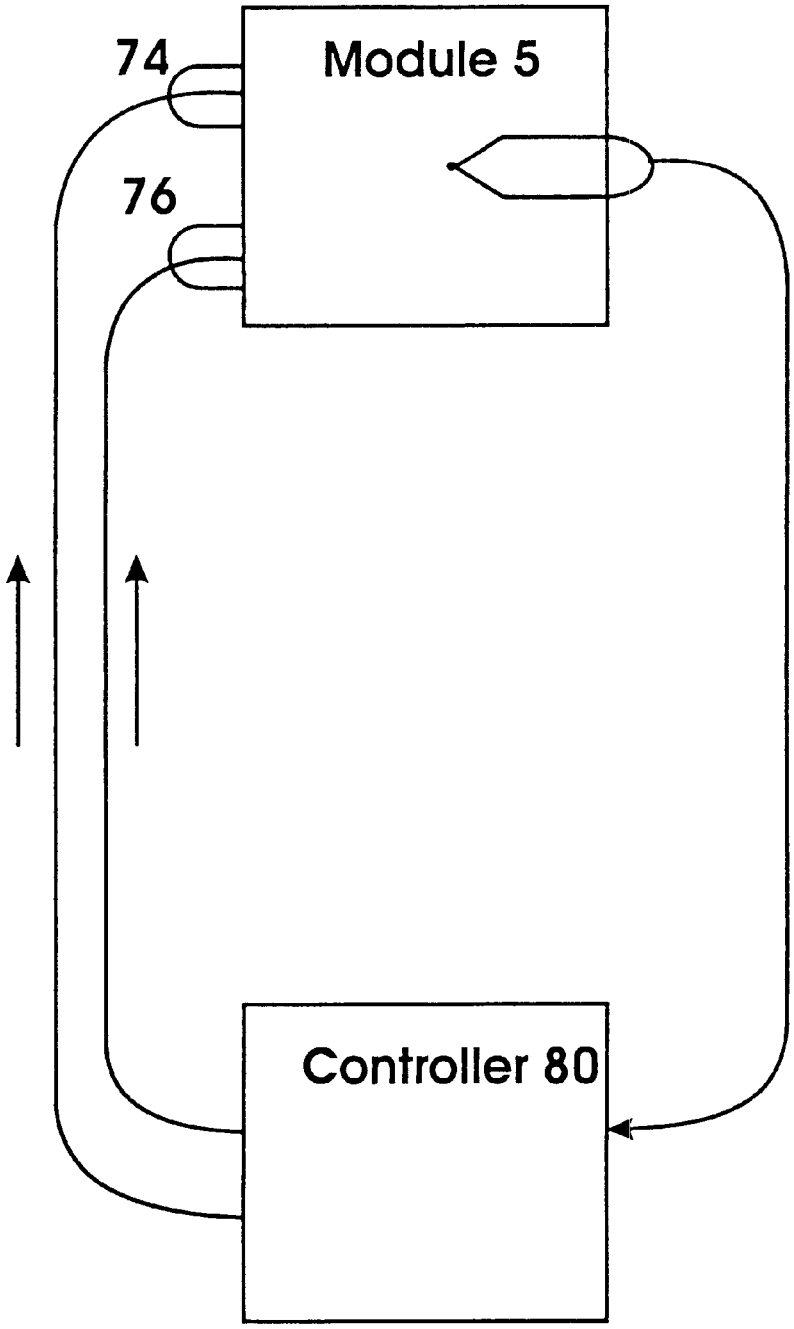
FIG. 22 is a schematic diagram of a system using a microscalable temperature control module for temperature control of an associated device.

In an exemplary embodiment, the diaphragm layers 14 and 16 are driven by electrostatic forces which are controlled by a controller 80, comprising an integrated circuit and generating device, schematically illustrated in FIG. 22. An exemplary controller 80 is adapted to create and output four or more individually controllable oscillating voltages or grounded connections, which are applied separately through electrical connections 74 and 76 to each diaphragm layer 14 and 16 and to at least one layer adjacent to each diaphragm layer 14 and 16. A controller 80 is adapted to independently adjust the magnitudes, phase, and frequency of each voltage output. A controller 80 is also adapted to calculating the optimum swept volume ratio for each diaphragm layer, using formulas that are well known to those skilled in the art, and to making adjustments to the voltage magnitude, phase of oscillation, or frequency of oscillation to optimize performance, as described below. A controller 80 is further adapted to accept a desired temperature for one or more sensor locations. A desired temperature may be accepted by a controller 80 before or during the operation of one or more modules 5.

Using a controller 80 to create a voltage differential across the first thermal transfer layer 10 and the first diaphragm layer 14 causes the first diaphragm layer 14 to deflect toward the first thermal transfer layer 10 into the first diaphragm clearance gap 46. Using a controller 80 to create a voltage difference between the first diaphragm layer 14 and the first entrance layer 22 causes the first diaphragm layer 14 to deflect toward the first entrance layer 22 into the first expansion/compression region 50. Switching the voltage applied between the first thermal energy transfer layer 10 and the first entrance layer 22 over time causes the first diaphragm layer 14 to oscillate sinusoidally. The second diaphragm layer 16 is similarly driven, so that it trails the oscillations of the first diaphragm layer 14 by a phase shift that optimizes the performance of the Stirling cooler for a particular application, typically 90 degrees to 120 degrees. Because the two diaphragm layers 14 and 16 are out of phase with each other, at times they will move in the same direction and at other times one or both will move toward or away from the other. These out of phase motions of the diaphragm layers 14 and 16 in sequence expand, move, compress, and return the working gas in a manner referred to as a Stirling cycle.

Figure 27:
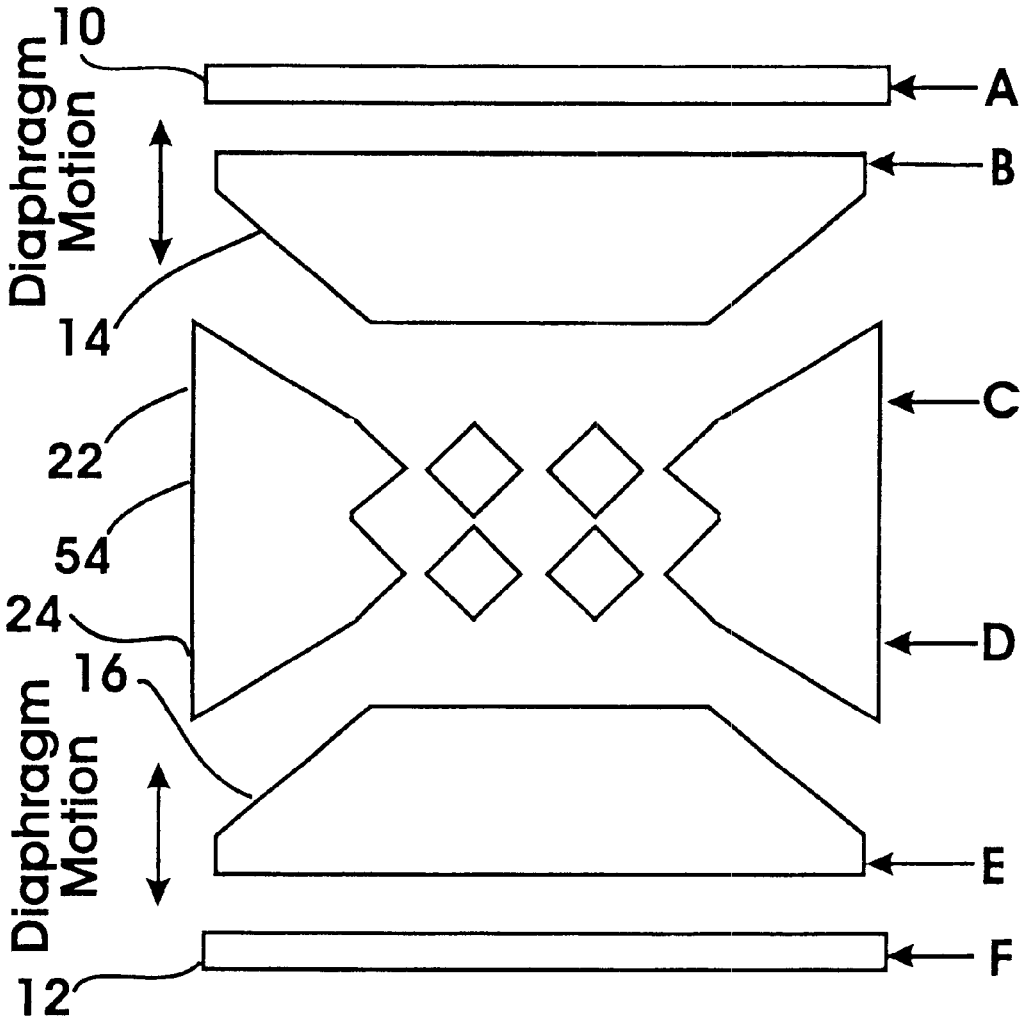
FIG. 27 is a schematic representation of a single regenerator region, with voltage application sites indicated as A–F.
Figure 28:
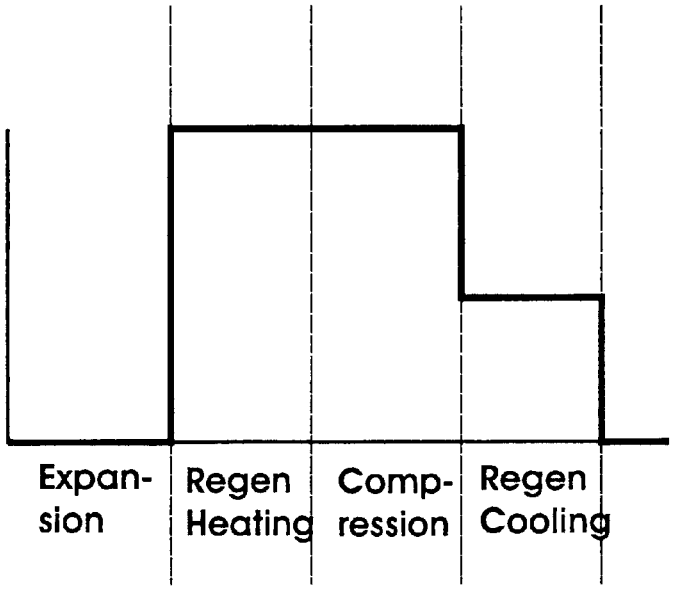
FIGS. 28 and 29 are schematic representations of exemplary voltages applied to drive the diaphragm layers of a microscalable temperature control module.
Figure 29:
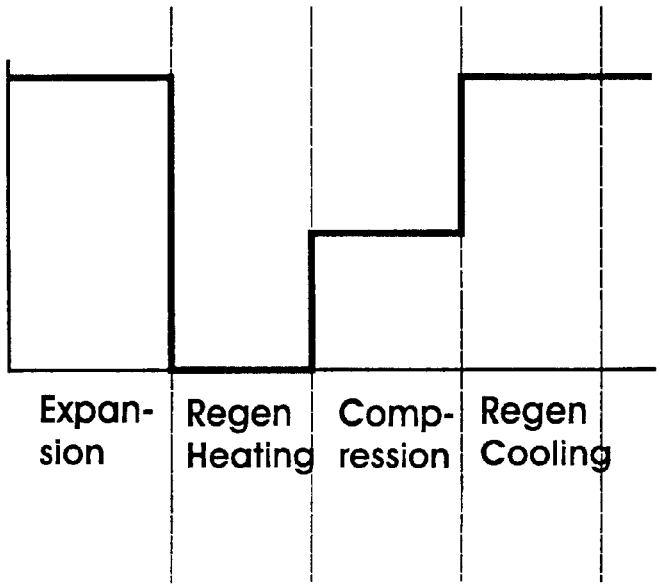

FIGS. 28 and 29 illustrate an exemplary embodiment of the process of driving the diaphragm layers 14 and 16 using electrostatic forces. Referring to the illustration in FIG. 27, the thermal energy transfer layers 10 and 12 and the diaphragm layers 14 and 16 are grounded by a grounded connection at points represented by A, B, E, and F. Voltage is applied, by methods known to those skilled in the art, to the first entrance layer 22 and the second entrance layer 24 at representational points C and D. The graph in FIG. 28 illustrates the voltage applied to the upper entrance layer 22 at representational point C during one complete cycle in cooling mode. The graph in FIG. 29 illustrates the voltage applied to the second entrance layer 24 at representational point D during one complete cycle in the cooling mode. The difference in voltage between the grounded diaphragm and the voltage applied to the entrance layers forces the diaphragm layers 14 and 16 to move in the manner illustrated in FIGS. 7, 8, and 9 through 13, discussed in more detail below.

Figure 30:
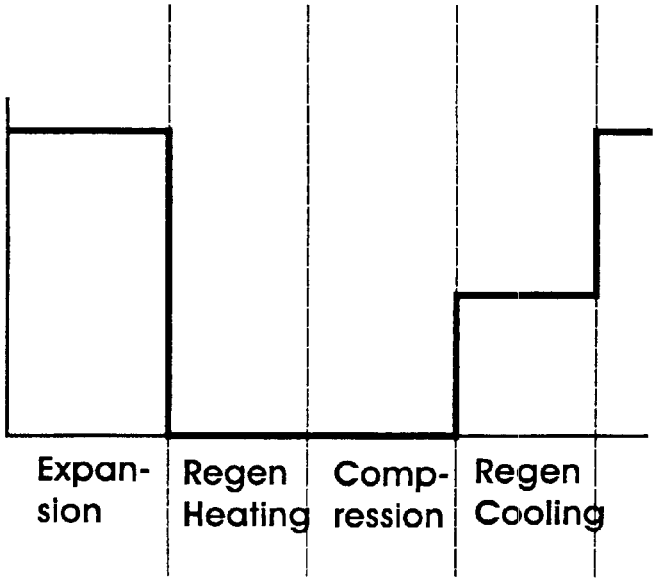
FIGS. 30 and 31 are a schematic representation of an alternative driving voltage arrangement.
Figure 31:
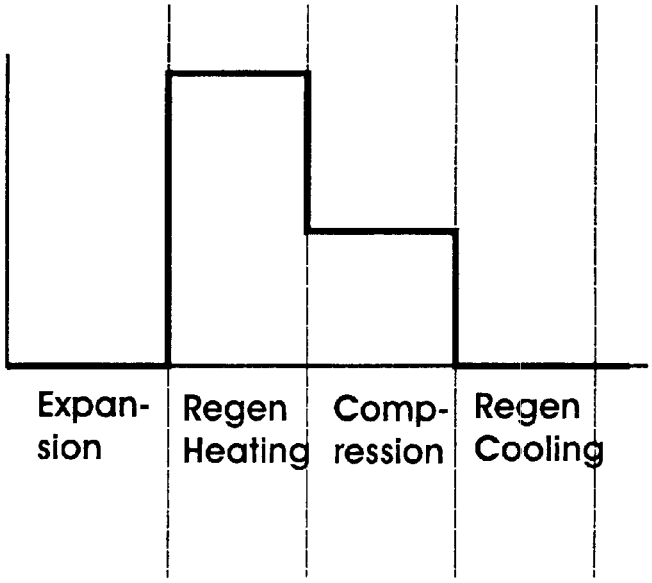

FIGS. 30 and 31 illustrate another exemplary embodiment of the process of driving the diaphragm layers 14 and 16 using electrostatic forces. Referring to the illustration in FIG. 27, the thermal energy transfer layers 10 and 12 are grounded at representational points A and F. The maximum voltage is applied to the first and second entrance layers 22 and 24 at representational points C and D. The voltage which varies over time is applied to the first and second diaphragm layers 14 and 16 at representational points B and E. The variation in voltage through one complete cycle in the cooling mode is illustrated in FIGS. 30 and 31. The graph in FIG. 30 illustrates the voltage applied to the first diaphragm layer 14 at representational point B. The graph in FIG. 31 illustrates voltage applied to the second diaphragm layer 16 at representational point E. The difference in voltage between the three layers forces the diaphragm layers 14 and 16 to move in the manner illustrated in FIGS. 7, 8, and 9 through 13, discussed in more detail below.

Figure 32:
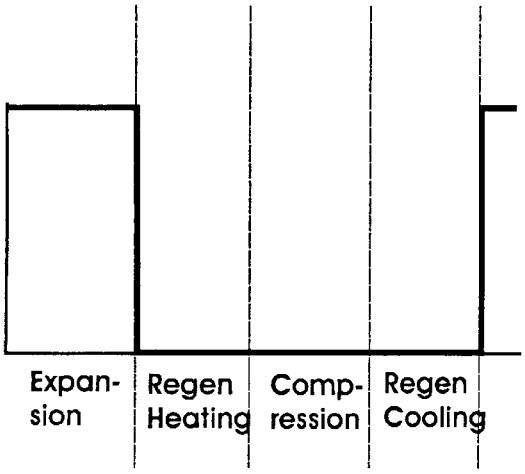
FIGS. 32–35 are a schematic representation of a third driving voltage arrangement.
Figure 33:
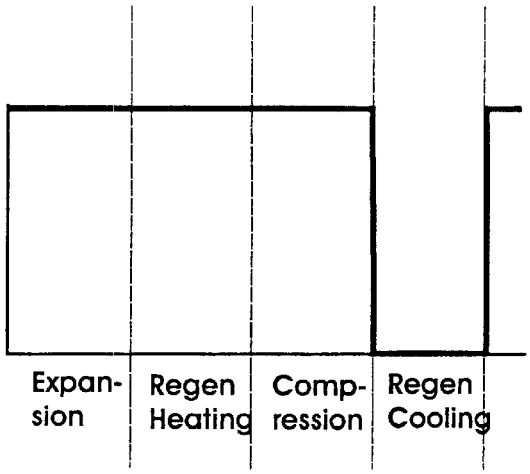
Figure 34:
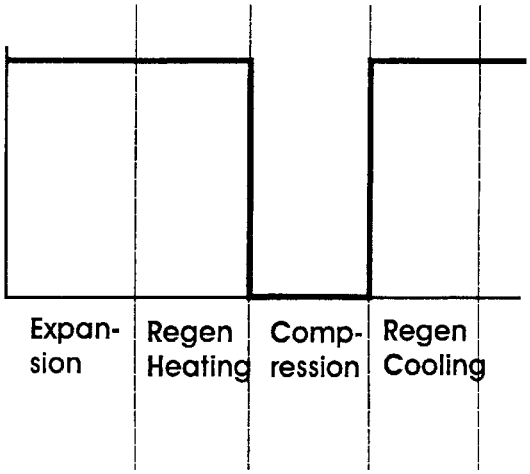
Figure 35:
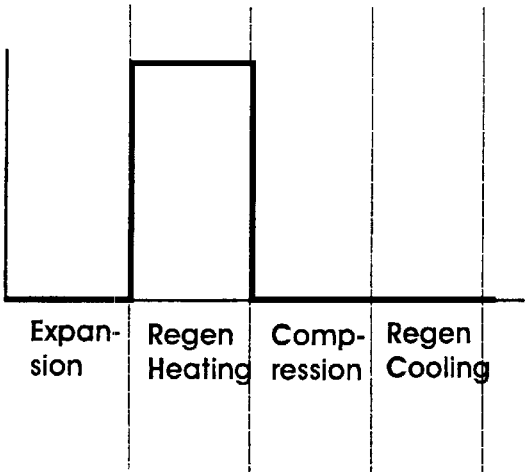

FIGS. 32, 33, 34, and 35 illustrate a third exemplary embodiment of the process of driving the diaphragm layers 14 and 16 using electrostatic forces. Referring to the illustration in FIG. 27, the thermal energy transfer layers 10 and 12 are grounded at representational points A and F. Voltage which varies i time is applied to both the diaphragm layers 14 and 16 at representational points B and E, and to the first and second entrance layers 22 and 24 at representational points C and D. The graph in FIG. 32 illustrates the voltage applied to the first diaphragm layer 14 at representational point B. The graph in FIG. 33 illustrates the voltage applied to the first entrance layer 22 at representational point C. The graph in FIG. 34 illustrates the voltage applied to the second entrance layer 24 at representational point D. The IS graph in FIG. 35 illustrates voltage applied to the second diaphragm layer 16 at representational point E. The varying differences in voltage between the three first layers 10, 14, and 22 forces the first diaphragm layer 14 to move in the manner illustrated in FIGS. 7 and 9 through 15, discussed in more detail below. The varying differences in voltage between the three second layers 12, 16, and 24 forces the second diaphragm layer 16 move in the manner illustrated in FIGS. 8 and 9 through 13, discussed in more detail below.

Figure 7:
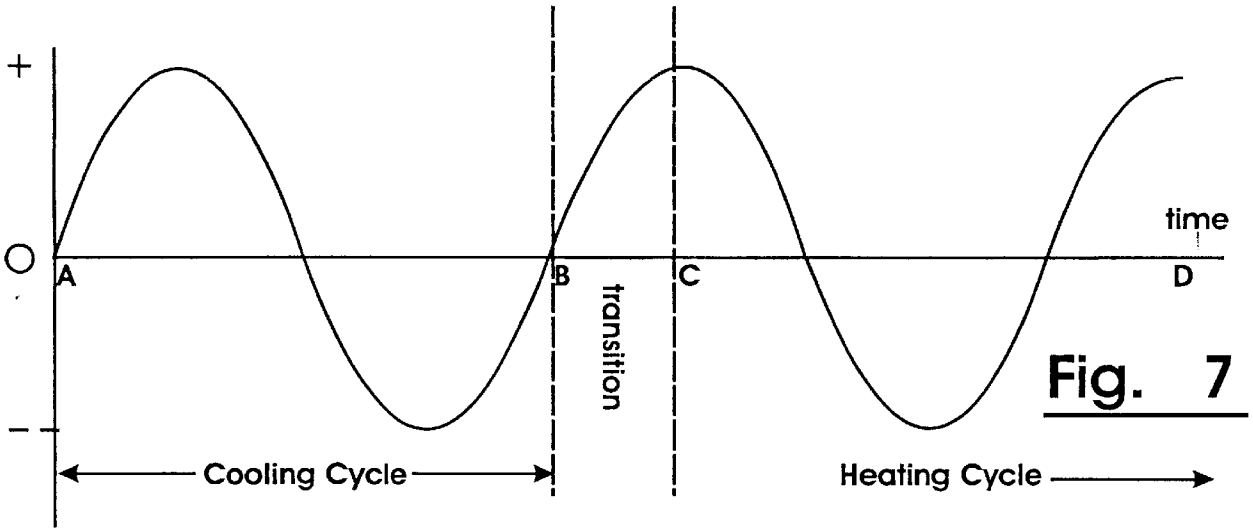
FIG. 7 is a graphical representation of the displacement of the first diaphragm layer from a cycle in cooling mode through the transition to a cycle in heating mode.
Figure 8:
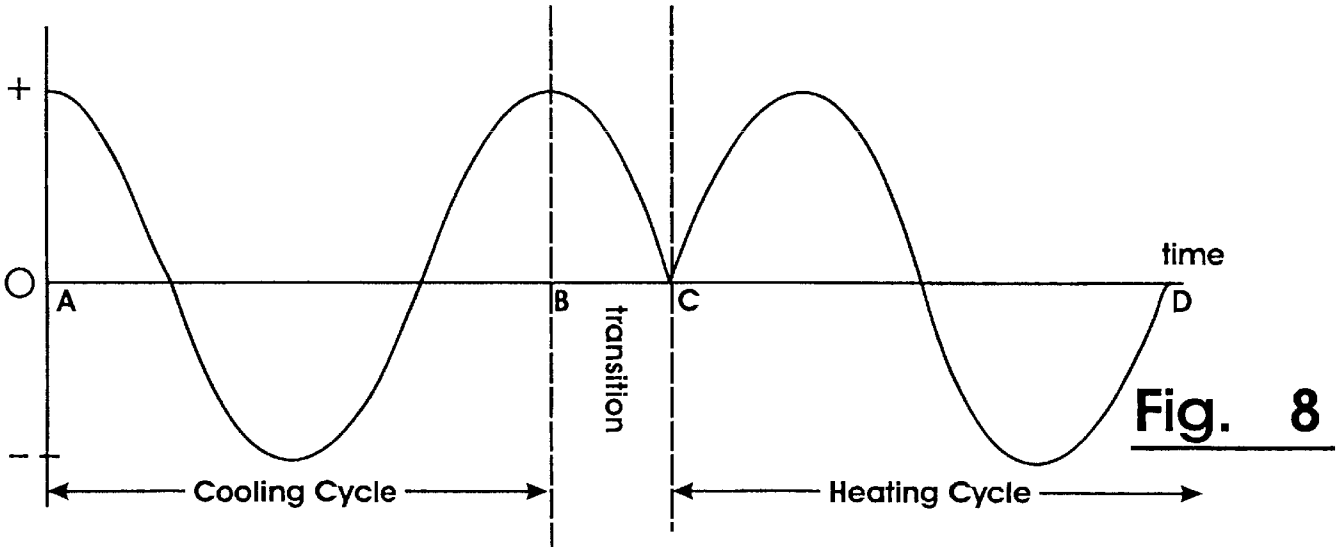
FIG. 8 is a graphical representation of the displacement of the second diaphragm layer from a cycle in cooling mode through the transition to a cycle in heating mode.
Figure 9:
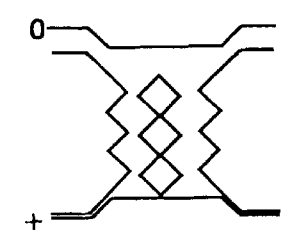
FIGS. 9–13 are schematic representations of a single regenerator region, and the relative displacements of the first and second diaphragm layers with respect to that regenerator region, through one complete cycle in the cooling mode.

FIGS. 7 and 8 graphically represent the displacement over time of the diaphragm layers 14 and 16 of module 5 during a cycle in cooling mode through transition and a cycle in heating mode. The motion of diaphragm layer 14 is represented by the graph in FIG. 7. The motion of diaphragm layer 16 is reprresented by the graph in FIG. 8. On both FIGS. 7 and 8, the symbol "+" represents the maximum displacement in the direction of the first thermal energy transfer layer 10. The symbol "−" represents the maximum displacement in the direction of the second thermal energy transfer layer 12. The number "0" represents no displacement.

The portion of FIGS. 7 and 8 between A and B represents the motion of diaphragm layers 14 and 16 respectively through a single cycle in cooling mode. The portion of FIGS. 7 and 8 between B and C represents the motions of diaphragm layers 14 and 16 during a transition from a cooling mode to a heating mode. The portion of FIGS. 7 and 8 between C and D represents the motion of diaphragm layers 14 and 16 respectively through a single cycle in heating mode.

Before transition, the thermal energy transfer layer 10 near diaphragm layer 14 is cool and the thermal energy transfer layer 12 near diaphragm 16 is warm. After it operates in heating mode for a brief period, thermal energy transfer layer 12 will become cooler and thermal energy transfer layer 10 will become warmer.

Figure 10:
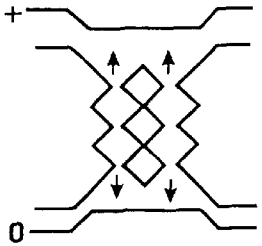

FIGS. 9 through 13 schematically represent the Stirling cycle during a cycle in cooling mode of this exemplary embodiment of a module 5. In the initial illustration, FIG. 9, the first diaphragm layer 14 is in its position of zero displacement, and the second diaphragm layer 16 is in its position of maximum positive displacement. The first diaphragm layer 14 then oscillates to its maximum positive displacement, while the second diaphragm layer 16 simultaneously returns to its position of zero displacement, as illustrated in FIG. 10. These motions initially expand and cool the working gas in the region near the first thermal energy transfer layer 10 of a module 5, resulting in heat being transferred from thermal energy transfer layer 10 to the working gas.

Figure 11:
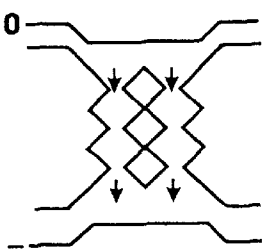

Next the first diaphragm layer 14 and the second diaphragm layer 16 both move toward the second thermal energy transfer layer 12, with the first diaphragm layer 14 returning to its position of zero displacement and the second diaphragm layer 16 moving to its position of maximum negative displacement, as illustrated in FIG. 11. This tandem motion forces the cool gas through the regenerators 54 toward the second thermal energy transfer layer 12. The gas, in its expanded state, is cooler than the layers of the regenerator 54. As the gas passes through regenerator layers 30, 32, and 34, heat is transferred from the regenerator layers 30, 32, and 34 to the working gas. This warms the working gas, and cools the regenerator layers 30, 32, and 34.

Figure 12:
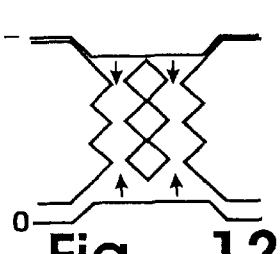

The first diaphragm layer 14 then continues its motion toward the second thermal energy transfer layer 12 to its position of greatest negative displacement, while the second diaphragm layer 16 returns to its position of zero displacement, as illustrated in FIG. 12. This motion compresses the gas, and heats it, resulting in heat transfer from the working gas to thermal energy transfer layer 12.

Figure 13:
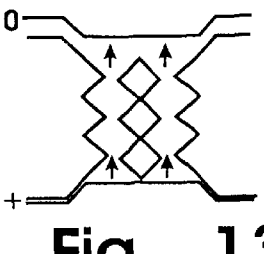

Finally, the first diaphragm layer 14 and second diaphragm layer 16 again move in tandem, with the first diaphragm layer 14 returning to its position of zero displacement and the second diaphragm layer 16 returning to its position of maximum positive displacement, as illustrated in FIG. 13. This forces the working gas back through the regenerators 54 toward the first thermal energy transfer layer. The heated gas is now warmer than the regenerators 54. As it passes through the regenerator layers 30, 32, and 34 heat from the working gas is transferred to the regenerator layers 30, 32, and 34. This cools the working gas, and warms the regenerator layers. This cycle continues, increasing the temperature difference between the first thermal energy transfer layer 10 and the second thermal energy transfer layer 10 until it reaches a steady state. In a steady state of a cooling mode the first thermal energy transfer layer 10 remains at a constant temperature that is lower than the temperature of the second thermal energy transfer layer 12. While not identical, temperature of the associated device being cooled approaches that of the first thermal energy transfer layer 10.

Although this exemplary embodiment utilizes electrostatic forces to displace the diaphragm layers 14 and 16, other methods such as piezoelectric, magnetic, bimetallic, shape memory alloy, thermopneumatic, or other, may be used in other embodiments.

Each module 5 has connectors 79 and 81, for example metallicized contacts, along the edges of the module 5 which permit the application of an electrical charge, or other driving force, to the layers. In an exemplary embodiment, these connectors permit the electrical charge, or other driving force to be transmitted to other modules 5 by direct physical contact between the connectors of one or more adjacent modules 5. In other embodiments the means of transmission of the driving forces may be different. In this exemplary embodiment, connectors 79 and 81 of certain modules 5 will act as terminal connectors and are adapted, by means known to those skilled in the art, to be connected with a controller 80 which drives the connected modules. In other embodiments, each module may be connected independently to a controller 80. In further embodiments, a plurality of modules 5 may be connected in groups to each other, with each independent group having at east one module 5 connected to one of a plurality of controllers 80.

The regenerator layers 30, 32, and 34 are relatively thermally isolated from each other because of the insulation layers 36, 38, 40, and 42. As a module 5 functions in cooling mode, the regenerator layers 30, 32, and 34 acquire relatively distinct temperatures, with the layer closest to the first thermal energy transfer layer 10 being the coolest and the layer closest to the second thermal energy transfer layer 12 being the warmest. The absolute temperatures of the layers will change over time, but the relive temperature gradient described will exist.

In an exemplary embodiment, the length of a regenerator passage 64 is relatively large in comparison to the diameter of each regenerator orifice 62. A high length to orifice diameter ratio maximizes the potential temperature difference between the first thermal energy transfer layer 10 and the second energy transfer layer 12. In addition, the funnel shape of the regenerator passage 64 minimizes the pressure loss as the working gas is forced through the regenerator passage. This also increases the efficiency of a module 5.

The device performance is also, in part, a function of the volume swept during the expansion/compression portions of the cycle. In an exemplary embodiment, the shape of the diaphragm layers 10 and 12 parallels the shape of the entrance layers 22 and 24. This parallel structure maximizes the volume swept when the diaphragm layers 14 and 16 are displaced, and minimizes the dead volume. The dead volume is that portion of the gas in the working gas region 66 that is not swept out by the motion of the diaphragm layers 10 and 12. In an exemplary embodiment, dead volume would be found, for example, in areas near the connection between the diaphragm layers 14 and 16 and the entrance layers 22 and 24. One such location is indicated by reference number 68 in FIG. 1. The dead volume also includes the internal volume of the regenerators passages 64.

Performance of a module 5 with particular physical characteristics may be optimized by adjusting the volume swept by the diaphragm layers 14 and 16 and by adjusting the phase shift between the oscillations of the diaphragm layers 10 and 12. The heating or cooling capacity of a particular module 5 depends on a number of factors related to its physical characteristics, including the number and thickness of regenerator layers 30, 32, and 34, the size and number per layer of regenerator orifices 62, the thickness of the diaphragm layer, the initial pressure in the sealed gas region, and the gas which is used. The cooling capacity of a module 5 with particular characteristics can be optimized during operation by adjusting the phase shift between the diaphragm layer oscillations and by adjusting the ratio of the swept volume in the warm compression end to the swept volume in the cool expansion end, and by adjusting the frequency of oscillations.

For ease of presentation, the illustrations in FIGS. 7 and 8, and FIGS. 28–29, 30–31, and 32–35 depict a 90 degree phase difference. Notwithstanding the illustrations, the optimum phase shift is generally between 90 degrees and 120 degrees, depending on factors which include the physical characteristics, the swept volume ratio, and the temperature ratio between the cool and warm ends of module. Once the optimum phase shift is determined, by experimental or theoretical means, the timing of the forces driving the diaphragm layers 10 and 12 can be adjusted to create the desired phase shift between the two oscillations. In an exemplary embodiment this adjustment may be made ore operation, during operation, or both. In other embodiments, the phase shift may be fixed during production of the module, or it may be permitted only before operation. In an embodiment that permits phase adjustment during operation, in addition to the transition phase adjustment, a controller 80 is used to make the adjustment.

The swept volume ratio is the ratio of the volume swept in the warm, compression, end to the volume swept in the cool, expansion, end. Generally, for performance to be optimized the volume swept in the warm end must be greater than the volume swept in the cool end. Once the optimum swept volume ratio is determined, it can be created by adjusting the magnitude of the driving forces associated with the movement of each diaphragm layer, to create greater or lesser displacement of the diaphragm layers 10 and 12. In an exemplary embodiment utilizing electrostatic forces, increasing the voltage difference causes a greater deflection and results in a greater swept volume. Likewise, decreasing the voltage difference decreases the deflection and results in a lower swept volume.

To adjust the swept volume ratio, the magnitude of the deflections of the two diaphragm layers relative to each other must be changed. Because the warm and cool ends of a module 5 may change during operation, as described more fully below, diaphragm layer refers to either diaphragm layer 10 or 12 and may change over time. Likewise, as described above the diaphragm layer may be driven by the voltage difference between it and the adjacent thermal energy transfer layer 10 or 12, or between it and the adjacent entrance layer 22 or 24, or by a combination of voltage differences between the three layers. The phrase adjacent layer, as used here, encompasses all these variations. In an exemplary embodiment, if the swept volume ratio needs to be increased, the voltage difference between the diaphragm layer in the warm end and the adjacent driving layer or layers would be increased or the voltage difference between the diaphragm layer in the cool end and the adjacent driving layer or layers would be decreased, or both.

Figure 14:
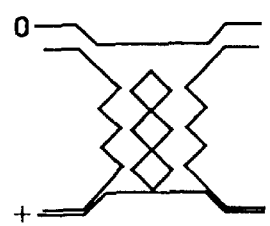
FIGS. 14–16 are schematic representations of a single regenerator region, and the relative displacements of the first and second diaphragm layers with respect to that regenerator region, through the transition between cooling mode and heating mode.
Figure 15:
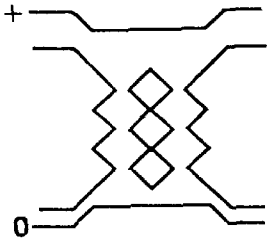
Figure 16:
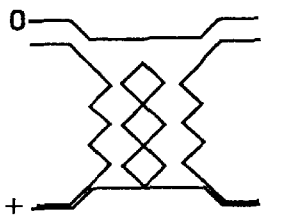
Figure 17:
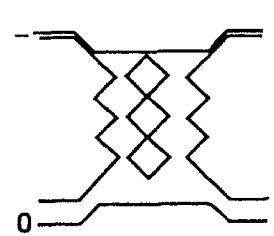
FIGS. 17–21 are schematic representations of a single regenerator region, and the relative displacements of the first and second diaphragm layers with respect to that regenerator region, through one complete cycle in the heating mode.
Figure 18:
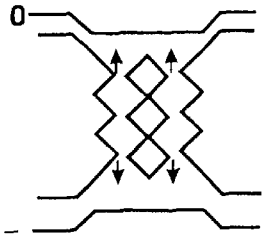
Figure 19:
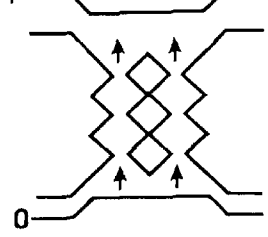
Figure 20:
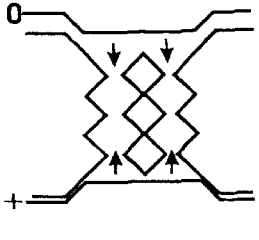
Figure 21:
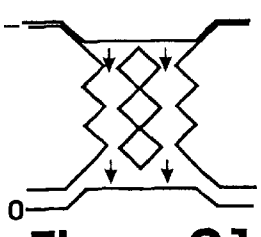

The heating and cooling surfaces of a module 5 may be reversed. This reversal may be accomplished by altering the phase of the oscillation of the diaphragm layers 14 and 16, as illustrated in FIGS. 14–16, and in portions B–C of FIGS. 7 and 8. The transition illustrated occurs at the end of a cycle in cooling mode with the positions of the diaphragm layers 14 and 16 in FIG. 14, the same as they were in FIG. 13. Although the transition illustrated occurs at the end of a cycle in cooling mode, it may occur at other points in the cycle, as well.

The first diaphragm layer 14 continues its normal cycle. Rather than continue to its position of maximum negative displacement, the second diaphragm layer 16 is made to return through its position of zero displacement back to its position of maximum positive displacement. This reversal is accomplished using a controller 80 to appropriately adjust the voltage difference between the second diaphragm layer and the adjacent driving layer. The second diaphragm layer 16 now leads the first diaphragm layer 14 by approximately 90 degrees, reversing the compression and expansion ends of a module 5. The reversal of the compression and expansion ends of a module 5 will, after a brief transition period, reverse the relative temperatures of the regenerator layers 30, 32, and 34. In an exemplary embodiment, regenerator layer 30 will become the warmest, and regenerator layer 34 will become the coolest.

FIGS. 17 through 21 schematically represent the Stirling cycle during the heating mode of this exemplary embodiment of a module 5. A cycle in heating mode functions identically to a cycle in cooling mode, with the exception that the working gas is now compressed and heated near the first thermal energy transfer layer 10. It is then transported through the regenerators 54. The working fluid transfer heat to the relatively cooler regenerator layers 30, 32, and 34 as it passes through. Next it is expanded and cooled near the second thermal energy transfer layer 12. It is then transported back through the regenerators 54. The working fluid receives heat from the relatively warmer regenerator layers 30, 32, and 34 as it passes through.

The theoretical ability of a Stirling cycle cooler to operate in reverse is known to those skilled in the art, however a design which permits alternating between cooling and heating while the device is operating is known. The means used to drive the working gas in traditional Stirling cycle coolers are associated with relatively large inertial and dynamic forces, due to the pistons and linkages typically used. These inertial and dynamic forces make it impossible to directly reverse the heating and cooling regions of a traditional Stirling cycle cooler during operation by shifting the cycle phase, without causing permanent damage to the cooler.

The problem of inertial and dynamic forces is resolved by the scale of this module 5 and the use of diaphragms rather than pistons. The inertial and dynamic forces associated with the motion of diaphragm layer 14 or 16, are relatively small when compared to the forces utilized to oscillate the diaphragm layers 14 and 16. Because of this the sinusoidal oscillations of a diaphragm layer 14 or 16 can be shifted 180 degrees almost instantaneously. When the shift is completed, the diaphragm layer 14 or 16 which had been leading by approximately 90 degrees trails by approximately 90 degrees. In an exemplary embodiment, this is accomplished by shifting the oscillations of the second diaphragm layer 16. In other embodiments it could be accomplished by shifting the oscillations of the first diaphragm layer 14, or by shifting the oscillations of both diaphragm layers 14 and 16.

In addition to shifting the relative phase of the oscillations, the relative volumes swept by each diaphragm layer may also be switched. Because in an exemplary embodiment the magnitude of each diaphragm layer oscillation is individually controlled by the controller 80, the reversal and swept volume changes can be easily accomplished without modification of the physical structure of a module 5, and can be done while a module 5 is operating.

Because it is possible to reverse the heating and cooling surfaces of a module 5, it is possible to attain any temperature that is within either the heating or cooling range of a module 5. Because it is possible to shift from heating to cooling very quickly; it is possible to maintain any temperature that can be reached by the device by repeatedly reversing the operation of a module 5 in response to a variation from the desired temperature.

FIG. 22 schematically illustrates how the temperature sensor 44 can be used to moderate the temperature of a module surface 8 or 9. In the schematic illustration, an exemplary embodiment is being used to moderate the temperature of the first module surface 8. The temperature sensor 44 provides at least one signal indicative of the temperature of the module surface 8 to the controller 80. Utilizing integrated electronics, the control device 80 determines whether a module 5 is operating in the heating or cooling mode.

If the temperature is too high and a module 5 is operating in the cooling mode, the controller 80 maintains the current operation in cooling mode. If the temperature is too high and a module 5 is operating in heating mode, the controller 80 effects a transition to cooling mode. In an exemplary embodiment, this is accomplished by shifting the relative phase of operation of the two diaphragm layers 14 and 16 by 180 degrees as illustrated in FIGS. 7 and 8. In an exemplary embodiment, this is accomplished by integrated electronics in the controller 80 which cause one diaphragm layer to repeat the prior 180 degrees of the oscillation cycle. In addition, the integrated electronics in the controller 80 may adjust the maximum voltage difference between the layers in the first diaphragm region so that it is equal to the previous maximum voltage difference between the layers in the second diaphragm region. Similarly, the controller 80 adjusts the maximum voltage difference between the layers in the second diaphragm region so that it is equal to the previous maximum voltage difference between the layers in the first diaphragm region. Although in this exemplary embodiment, one diaphragm layer is caused to repeat the prior 180 degrees of its oscillation cycle, in other embodiments other adjustments may be made to shift the relative oscillations 180 degrees. This may be accomplished, for example, by causing one diaphragm layer to shift 180 degrees ahead in its oscillation cycle, or by causing part of the 180 degree phase shift to occur in each of the two diaphragm layers.

Although in one exemplary embodiment, the swept volume ratio is adjusted by reversing the relative magnitudes of the oscillations from one end of a module 5 to the other, it may be accomplished differently in other embodiments. For example, in another embodiment, the integrated electronics in the controller 80 may calculate the optimum swept volume for each diaphragm layer and may control it directly rather than merely switching the previously selected magnitudes. In further embodiments, the optimum swept volume for each diaphragm layer may be determined by the controller 80 solely, or in part, based on the feedback from the temperature sensor 44.

If the temperature is too low and a module 5 is operating in the heating mode, the controller 80 maintains the current operation heating mode. If the temperature is too low and a module 5 is operating in cooling mode, the controller 80 effects a transition to heating mode. In an exemplary embodiment this is accomplished as described above.

The temperature sensor 44 then provides at least one signal indicative of the temperature of the apparatus surface to the controller 80, which, if necessary, directs further adjustments. By linking the temperature sensor 44 to the controller 80 and using the temperature feedback to maintain the operation or to transition between heating mode and cooling mode, a module 5 can be made to reach and maintain any temperature chosen within the temperature range of a module 5. To maintain the temperature within a very narrow range, the sensing and control electronics would need to check and adjust for temperature frequently. If larger fluctuations in temperature are acceptable, the sensing and control electronics could check and adjust temperature less frequently.

Although this exemplary embodiment uses a feedback process to monitor and control the temperature of a module 5, with potentially frequent transitions between heating and cooling, it should be understood that other embodiments may employ different processes to monitor and control the temperature of a module 5. For example, the temperature sensing device may be located on the associated item being thermally controlled, or may comprise a plurality of individual sensing devices and adjustments may be directed by the controller 80 based on a function which incorporates a plurality of sensed temperatures. Further, the temperature adjustment in this exemplary embodiment is made by a transition between heating mode and cooling mode. In other embodiments, minor temperature adjustments may be accomplished, for example, by adjusting the amplitude of the oscillations of diaphragm layers 14 and 16, resulting in a change in the volume swept ratio by the diaphragm layers 14 and 16. The change in the volume swept ratio causes a change n the temperature differential between the warm and cool ends of a module 5.

An exemplary embodiment of this module 5 is modular. The modular nature of its design gives it several advantages. A single module 5 can be used for both moderated heating and cooling. In the past, separate devices were generally needed for heating and cooling. In addition, earlier Stirling coolers did no provide for temperature moderation. The operating temperature was generally a function of the design of the Stirling cooler. Moderation, if needed, could be accomplished by using a Stirling cooler of a different design.

Using a module 5, so long as the desired temperature is within the combined heating and cooling range of a module 5, a single module 5 can be used to heat, cool, and control the temperature of an associated item. In addition, the modular design also permits the simultaneous operation of more than one module 5. By operating a plurality of modules 5, it is possible to increase the heating and cooling capabilities. A plurality of modules 5 may be operated in parallel, as illustrated in FIG. 24 to cool a larger surface area. The size and modularity of a module 5 also permits the arrangement of a plurality of modules 5 to closely matches the footprint of an associated item. Because of this, it is often more efficient to use a plurality of modules 5 to control the temperature of an associated item with an irregular footprint than it would be to use a regularly shaped Stirling device with a surface area that is identical to that of the plurality of modules 5 but the footprint of which does not match the footprint of the associated item. Each module 5 may be controlled individually for temperature, if precise point by point temperature control is desired. In other embodiments, a single controller 80 may be used to control the operation of two or more modules 5 operating in parallel.

The modular design also permits the operation of a plurality of modules 5 in series, as illustrated in FIG. 23. In an exemplary embodiment, the series of modules 5 is being used to cool the surface above it. The cool surface of module 86 is adjacent to the warm surface of module 88. As a result, the warm surface of module 88 is cooled. Because the Stirling cycle creates a temperature difference between opposing surfaces of module 88, the cool surface of module 88 is driven lower. In like manner, the cool surface of module 88 is adjacent to the warm surface of module 90. As a result, the warm surface of module 90 is cooled. The temperature difference created by the Stirling cycle drives the temperature of the cool surface of module 90 lower.

Although an increased cooling range is illustrated by the described exemplary embodiment, it is also possible to operate a series of modules 5 in heating mode. In that event, the series operation increases the heating range. Although an exemplary embodiment comprises three modules 5, other embodiments may comprise fewer or more modules 5. As with a single device, it is possible to select and maintain any steady state temperature within the combined range by using the feedback and control mechanisms described above.

Although the two exemplary embodiments described above use a plurality of modules 5 in either series or parallel, other embodiments may combine series and parallel operation. A plurality of modules 5 may be combined in series and parallel so that the outer surfaces of the combined modules 5 form a rectangular prism. This embodiment provides a uniform capacity to moderate the temperature over a surface area that is larger than that of a single module 5. If the need to heat or cool a surface is not uniform, modules 5 may be arranged in parallel in an irregular footprint, stacked in series to nonuniform heights to provide different heating and cooling capabilities at different locations.

Modules 5 may also be used to control the temperature of curvilinear surfaces, so long as the radius of curvature is significantly greater than the characteristic dimensions of each module 5. Such an arrangement is illustrated in FIG. 25. In this exemplary embodiment, a plurality of modules 5 are attached to a shared bottom plate 82. The shared bottom plate 82 is made from semiconductor materials in this exemplary embodiment, although in other embodiments it may be made of different materials. Most traditional curvilinear surfaces have a radius of curvature R that is extremely large, relative to the characteristic dimension x of a module 5. Because of this, the strain of adjusting to a curvilinear surface is within the material capabilities of the semiconductor materials of interest.

Although an exemplary embodiment uses a plurality of modules 5 to control the temperature of a curvilinear surface, other embodiments may be used to control the surface of any non-planar surface, so long as the radius of curvature of each portion of the surface is large compared to the characteristic dimension x of module 5. An exemplary embodiment illustrates a plurality of modules 5 attached to a shared bottom plate 82, other embodiments may use different means of distributing modules 5 over the non-planar surface.

It is also possible to exploit the inherent oscillation frequency associated with a given diaphragm layer to enhance the operation of a module 5. The vibrations may be controlled by carefully matching the natural frequency of the diaphragm layers 14 and 16 so that they vibrate in phase with frequency of the oscillations used to drive the working gas, and increase the amplitude of the diaphragm layer oscillations and corresponding swept volume.

Figure 26:
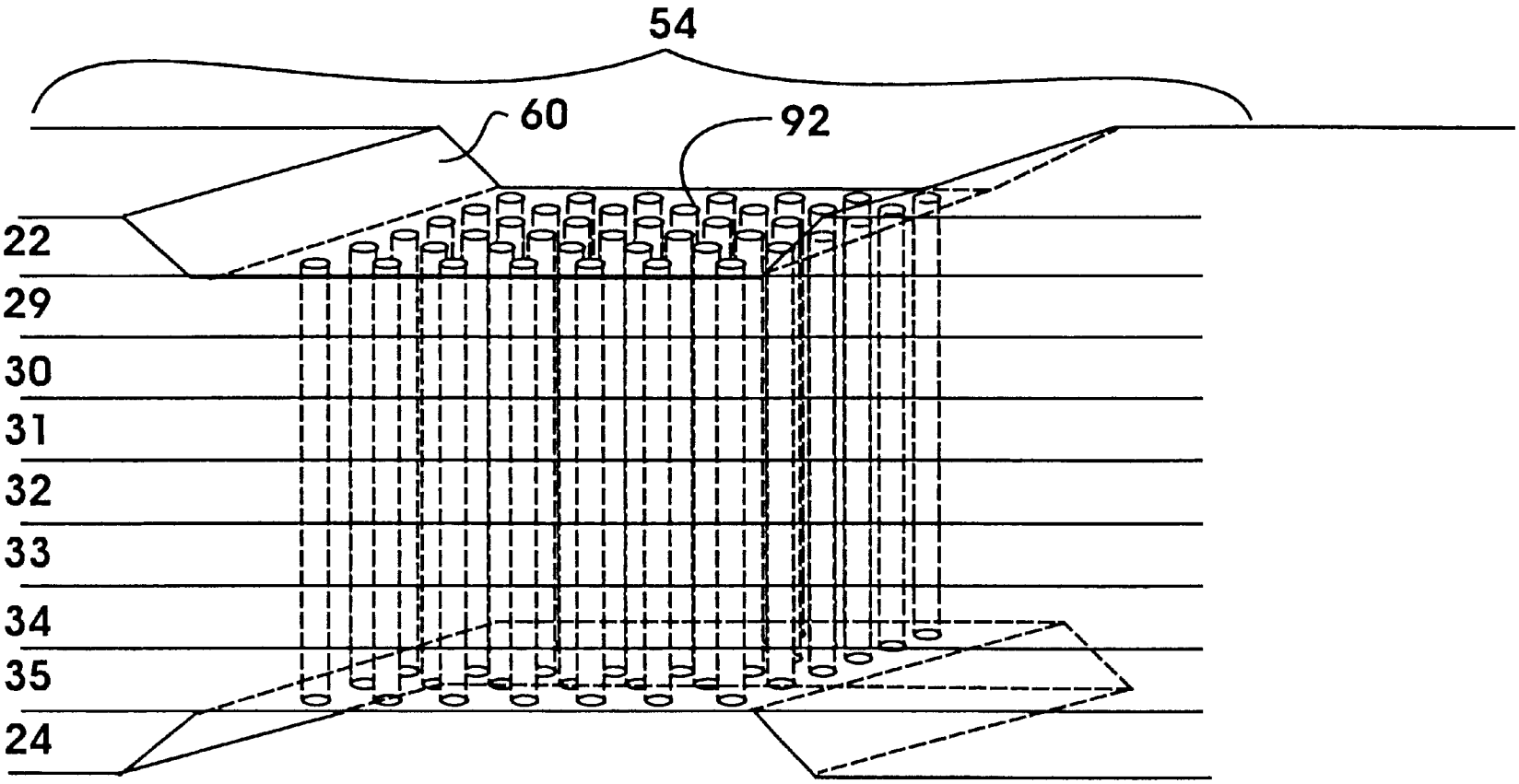
FIG. 26 is a partial cut-away view of an alternative regenerator design.

An exemplary embodiment of module 5 illustrated in FIG. 1 utilizes a regenerator 54 with an internal structure that is formed by etching each regenerator layer 30, 32 and 34 before bonding it to the next. An alternative exemplary embodiment of a regenerator 54 is illustrated in FIG. 26. In this exemplary embodiment, the cylindrical regenerator passages 92 through the regenerator layers 29–35 are created after the layers are bonded together, by techniques known to those skilled in the art. Although seven regenerator layers 29–35 are shown in an exemplary embodiment, other embodiments may have fewer or more than seven layers.

This exemplary embodiment of a regenerator 54 has an advantage that it is easier to assemble. In an exemplary embodiment illustrated in FIGS. 5 and 6, the layers must be precisely aligned before bonding so that the regenerator passages 64 line up. Because the regenerator layers 29–35 are bonded before the cylindrical regenerator passages 92 are created in this embodiment, the process of aligning is unnecessary, eliminating tolerance errors inherent in the alignment process. This facilitates the overall construction of this exemplary embodiment. As with the exemplary embodiment previously discussed, the regenerator layers 29–35 may be electrically or thermally isolated from each other.

The performance parameters may be slightly altered by the alternative structure of the regenerator 54. Otherwise, despite the different appearance of the cylindrical regenerator passages 92, an exemplary embodiment of module 5 using the regenerator 54 that is illustrated in FIG. 26 functions in the same manner as an exemplary embodiment discussed above. Two exemplary embodiments of the regenerator 54 have been discussed. Other suitable regenerator embodiments may be used as well.

It should be understood that the microscalable temperature control module 5, and the feedback and control mechanisms shown and described herein are exemplary. Other microscalable temperature control modules 5, and the feedback and control mechanisms within the scope of the present invention will be apparent to those having skill in the art from the teachings herein.

Thus the microscalable temperature control module 5, and the feedback and control mechanisms achieve the above stated objectives, eliminate difficulties encountered in the use of prior devices and systems, solve problems and attain the desirable results described herein.

In the foregoing description certain terms have been used for brevity, clarity, and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function and shall not be limited to the structures shown herein or mere equivalents thereof.

Having described the features, discoveries and the principles of the invention, the manner in which it is constructed and operated and the advantages and useful results attained; the new and useful structures, device elements, arrangements, parts, combinations, systems, equipment, operations, methods and relationships are set forth in the appended claims.

I claim:

1. An apparatus comprising:

bonded layers of semiconductor material comprising:

first and second diaphragm layers, which may be electrically or thermally isolated from adjacent layers;

a plurality of regenerator layers in electrical and thermal isolation from each other interposed between the first and second diaphragm layers;

a first thermal energy transfer layer which is roughly parallel to and exterior to the first diaphragm layer, adapted to transfer heat to or accept heat from an associated item with which it is in contact; and a second thermal energy transfer layer which is roughly parallel to and exterior to the second diaphragm layer, adapted to accept heat from or transfer heat to an associated item with which it is in contact or to the surrounding atmosphere;

an internal structure that is created by removing portions from one or more of the preceding layers, that structure comprising:

a plurality of regenerators, each comprising a cluster of passages through the regenerator layers and the portions of each regenerator layer adjacent to the cluster of passages;

a hermetically sealed cavity, containing a working gas, that is formed within the diaphragm and regenerator layers and which extends from the inner surface of the first diaphragm layer to the inner surface of the second diaphragm layer, and passes through the regenerators, wherein:

the diaphragm layers are adapted to move a working gas back and forth within the hermetically sealed cavity through the regenerator layers, and the regenerators are adapted to alternately accept heat from or transfer heat to a working gas that is driven through them by the diaphragm layers;

cavities between the first diaphragm layer and the first thermal energy transfer layer and between the second diaphragm layer and the second thermal energy transfer layer;

an electronic control device adapted to form an operative connection with the diaphragm layers and one or more adjacent layers of the apparatus comprising a force generating device and an integrated circuit that is adapted to:

produce variable driving forces that independently deflect each diaphragm layer in a regular oscillating pattern, coordinate the deflection of the first diaphragm layer with the deflection of the second diaphragm layer to produce a thermodynamic cycle, known as a Stirling cycle, which creates a temperature difference between the first and second thermal energy transfer layers, determine the optimum phase relation between the diaphragm layers, the optimum frequency, and the optimum swept volume ratio to maximize the potential temperature difference between the first and second thermal energy transfer layers for a particular application, and adjust the phase, frequency, and amplitude of the driving forces to maximize the potential temperature difference between the first and second the al energy transfer layers.

2. The apparatus of claim 1 wherein the surface area of the apparatus is as small as 0.01 $mm^2$.

3. The apparatus of claim 1 wherein the variable driving forces are electrostatic forces.

4. The apparatus of claim 1 in which each of the diaphragm layers contains a plurality of boss features in one to one correspondence with a plurality of regenerators.

5. The apparatus of claim 4 in which each of the boss features has sloped sides which are parallel to, and approximately the same size as, sloped sides in each portion of the outer regenerator layer, known as the entrance layer, that is adjacent to the cluster of passages through the regenerator layers, this sloped area being known as the regenerator entrance.

6. The apparatus of claim 4 in which each of the regenerators is comprised of:

the portions of each regenerator layer that are directly between corresponding pairs of boss regions on the first and second diaphragm layers, a cluster of passages through the portions of each regenerator layer wherein:

each cluster of passages is comprised of a plurality of adjacent passages, wherein each passage comprises a series of identical rectangular truncated pyramid shaped cavities in two to one correspondence with regenerator layers, wherein the cavities are arranged in alternating orientation so that large base of each cavity coincides with the outer surface of a regenerator layer and the small base of each cavity meets the small base of a second cavity in the center of the same regenerator layer; and the portions of the regenerator layers surrounding each cluster of passages do not contain passages through the regenerator layers.

7. The apparatus of claim 4 in which each of the regenerators is comprised of:

the portions of each regenerator layer that are directly between corresponding pairs of boss regions on the first and second diaphragm layers;

a cluster of passages through the regenerator layers wherein each cluster of passages through the regenerator layers is comprised of a plurality of closely spaced individual passages, with the cross section of each individual passage through the regenerator layers remaining constant, and wherein the portions of the regenerator layers surrounding each cluster of passages do not contain passages through the regenerator layers.

8. The apparatus of claim 1 wherein the electronic control device is adapted to shift the oscillation phase of at least one of the diaphragm layers and to adjust the magnitude of the deflection of each of the diaphragm layers.

9. The apparatus of claim 8 wherein the electronic control device is adapted to reverse the Stirling cycle by shifting the oscillation phase of at least one of the diaphragm layers, so that the diaphragm layer which initially performed the expansion role in a Stirling cycle subsequently performs the compression role in a Stirling cycle, and vice versa, thus switching the hot and cold thermal energy transfer layers of the apparatus.

10. The apparatus of claim 8 wherein the electronic control device is further adapted to adjust the performance of the apparatus by creating a desired phase relationship between the oscillations of the first and second diaphragm layers by precisely adjusting the oscillation phase of at least one of the diaphragm layers.

11. The apparatus of claim 8 wherein the electronic control device is adapted to adjust the performance of the apparatus by creating a specific swept volume ratio by adjusting the magnitude of the deflection of each of the diaphragm layers.

12. The apparatus of claim 8 wherein the electronic control device is adapted to receive a signal indicative of a sensed temperature.

13. The apparatus of claim 12 in which the sensed temperature is received from a temperature sensor attached to the first thermal energy transfer layer and is indicative of the temperature of the first thermal energy transfer layer.

14. The apparatus of claim 13 wherein the temperature sensor is a thin film temperature sensor embedded in channels in and flush with the first thermal energy transfer layer.

15. The apparatus of claim 12 in which the sensed temperature is received from a temperature sensor attached to an associated item, and is indicative of the temperature of that associated item.

16. The apparatus of claim 12 wherein the electronic control device is adapted to reverse the hot and cold ends if the apparatus in response to at least one signal indicative of a sensed temperature.

17. The apparatus of claim 16 wherein the electronic control device is adapted to:

accept information from an external source, that information comprising one or more of the desired sensed temperature from one or more temperature sensors, frequency of temperature feedback, and acceptable temperature range, and utilize that information to control the operation of the diaphragm layers so that the temperature control achieved is characterized by the entered information.

18. The apparatus of claim 1 wherein the edge of each diaphragm layer and of each layer adjacent to each diaphragm layer contains at least one electrically conductive feature which, when placed in abutting connection with the corresponding electrically conductive features of an adjacent apparatus, causes the diaphragm layers of the adjacent apparatus to operate with the same oscillation frequency, phase, and magnitude as the corresponding diaphragm layers of first apparatus.

19. A method of fabricating an apparatus comprising:

fabricating a first and second thermal energy transfer layer from semiconductor materials, wherein any non-planar features of the thermal energy transfer layers are created using a wet etching process;

fabricating a first and second diaphragm layer from semiconductor materials, wherein any non-planar features of the diaphragm layers are created using a wet etching process;

fabricating a regenerator matrix comprising layers of semiconductor materials, wherein each layer contains a plurality of holes which align in one to one correspondence with a plurality of holes in each adjacent regenerator layer;

assembling the apparatus in a controlled environment containing a working gas by placing together, from outside to inside, the thermal energy transfer layers, the diaphragm layers, and the regenerator matrix, and bonding each layer to any adjacent layer, thus hermetically sealing a working gas within the assembly; and attaching an electrical connector that is adapted to form an operative connection with the electrical connector on an adjacent module or on an electronic control device, said electronic control device being adapted to produce variable driving forces that independently deflect each diaphragm layer in a regular oscillating pattern;

coordinate the deflection of the first diaphragm layer with the deflection of the second diaphragm layer to produce a thermodynamic cycle which creates a temperature difference between the first and second thermal energy transfer layers, known as a Stirling cycle;

further adjust the phase, amplitude, and frequency of the forces in a manner that optimizes the potential temperature difference between the first and second thermal energy transfer layers; and receive a signal indicative of a sensed temperature.

20. The method of fabricating an apparatus of claim 19, wherein the surface area of each layer is as small as 0.01 $mm^2$.

21. The method of fabricating an apparatus of claim 19, wherein the variable driving forces are electrostatic forces.

22. The method of fabricating an apparatus of claim 19, wherein the fabrication of the regenerator matrix further comprises:

creating non-planar features of each regenerator layer using a wet etching process;

coating the planar portions of the surfaces of each regenerator layer with material that is thermally and electrically insulating;

aligning the coated regenerator layers so that any openings in one regenerator layer align with openings in any adjacent regenerator layer; and bonding the regenerator layers together, after creating the non-planar features, to form a regenerator matrix.

23. The method of fabricating an apparatus of claim 19, wherein the fabrication of the regenerator matrix further comprises:

coating the surface of each regenerator layer with material that is electrically and thermally insulating;

bonding the coated regenerator layers together to form a regenerator matrix; and creating a plurality of separated clusters of closely spaced passages through all regenerator layers after they are bonded together.

24. The method of fabricating an apparatus of claim 19, wherein the assembly step further comprises coating the surfaces of one or more layers with a thermally or electrically insulating material before the layers are bonded together.

25. The method of fabricating an apparatus of claim 19 wherein the assembly step further comprises affixing a temperature sensor to the first thermal energy transfer layer, the temperature sensor being adapted to provide a signal to the electronic control device indicative of the temperature of the first thermal energy transfer layer.

26. The method of fabricating an apparatus of claim 25 wherein the temperature sensor is a thin film temperature sensor.

27. The method of fabricating an apparatus of claim 25, wherein one of the non-planar features of one of the thermal energy transfer layers is a channel in which the temperature sensor can be embedded so that it is flush with the surface.

28. The method of controlling the temperature of an item by placing it in contact with the first thermal energy transfer layer of the apparatus of claim 1.

29. The method of controlling the temperature of an item at a precise location, as small as 0.02 $mm^2$, by placing the first thermal energy transfer layer of the apparatus of claim 2 in contact with an associated item at the precise location to be cooled.

30. The method of increasing the ability to control the temperature of an associated item by placing a plurality of apparatuses of claim 1 adjacent to each other, so that electrical connectors of each apparatus are in operative connection with electrical connectors of each adjacent apparatus, thus increasing the effective heating or cooling surface area and heating and cooling capacity of the apparatuses.

31. The method of increasing the temperature range of the apparatus of claim 1 by stacking a plurality of the apparatuses on top of one another, thus increasing the effective temperature range of the apparatus of claim 1.

32. The method of controlling the temperature of items with a wide variety of surface shapes by mounting a plurality of apparatuses of claim 1 on a common non-planar surface with a shape corresponding g to the shape the surface of the item to be cooled.

33. The method of controlling the temperature of an item by placing it in contact with the first thermal energy transfer layer of the apparatus made by the method of claim 19.

34. The method of controlling the temperature of an item at a precise location, as small as 0.02 $mm^2$, by placing the first thermal energy transfer layer of the apparatus made by the method of claim 20 in contact with an associated item at the precise location to be cooled.

35. The method of increasing the ability to control the temperature of an associated item by placing a plurality of apparatuses made by the method of claim 19 adjacent to each other, so that electrical connectors of each apparatus are in operative connection with electrical connectors of each adjacent apparatus, thus increasing the effective heating or cooling surface area and heating and cooling capacity of the apparatuses.

36. The method of increasing the temperature range of the apparatus made by the method of claim 19 by stacking a plurality of the apparatuses on top of one another, thus increasing the effective temperature range of the apparatus made by the method of claim 19.

37. The method of controlling the temperature of items with a wide variety of surface shapes by mounting a plurality of apparatuses made by the method of claim 19 on a common non-planar surface with a shape corresponding to the shape the surface of the item to be cooled.

* * * * *